US006180303B1

(12) United States Patent
Uematsu et al.

(10) Patent No.: US 6,180,303 B1
(45) **Date of Patent: *Jan. 30, 2001**

(54) ELECTROPHOTOGRAPHIC PHOTOSENSITIVE MEMBER, PROCESS CARTRIDGE AND ELECTROPHOTOGRAPHIC APPARATUS, AND PROCESS FOR PRODUCING THE SAME PHOTOSENSITIVE MEMBER

(75) Inventors: Hiroki Uematsu, Shizuoka-ken; Akio Maruyama, Tokyo; Toshihiro Kikuchi, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/330,602

(22) Filed: Jun. 11, 1999

(30) Foreign Application Priority Data

Jun. 12, 1998 (JP) ..... 10-164930
Jun. 12, 1998 (JP) ..... 10-164931

(51) Int. Cl.[7] ..... G03G 5/04
(52) U.S. Cl. ..... 430/59.6; 399/159; 430/58.85
(58) Field of Search ..... 430/59.6, 58.85; 399/156

(56) References Cited

U.S. PATENT DOCUMENTS

| | | | | |
|---|---|---|---|---|
| 4,798,777 | | 1/1989 | Takiguchi et al. | 430/59 |
| 5,176,976 | | 1/1993 | Kikuchi et al. | 430/58 |
| 5,352,552 | | 10/1994 | Maruyama et al. | 430/18 |
| 5,391,449 | | 2/1995 | Maruyama et al. | 430/66 |
| 5,455,135 | | 10/1995 | Maruyama et al. | 430/58 |
| 5,464,718 | * | 11/1995 | Kashizaki et al. | 430/59.6 |
| 5,486,439 | | 1/1996 | Sakakibara et al. | 430/59 |
| 5,677,095 | | 10/1997 | Kikuchi et al. | 430/58 |
| 5,734,003 | | 3/1998 | Iwasaki et al. | 528/89 |
| 5,876,890 | * | 3/1999 | Kitamura et al. | 430/59.6 |
| 5,882,813 | * | 3/1999 | Matsushima et al. | 430/58.85 |
| 5,910,610 | * | 6/1999 | Kobayashi et al. | 430/58.85 |
| 5,989,765 | * | 11/1999 | Kobayashi et al. | 430/58.85 |

FOREIGN PATENT DOCUMENTS

| | | |
|---|---|---|
| 4339711 | 5/1995 | (DE) . |
| 0295126 | 12/1988 | (EP) . |
| 0529878 | 3/1993 | (EP) . |
| 143645 | 11/1979 | (JP) . |
| 127652 | 5/1990 | (JP) . |
| 216249 | 8/1993 | (JP) . |
| 072640 | 3/1995 | (JP) . |
| 248649 | 9/1996 | (JP) . |
| 97/33193 | 9/1997 | (WO) . |

* cited by examiner

*Primary Examiner*—John Goodrow
(74) *Attorney, Agent, or Firm*—Fitzpatrick,Cella Harper & Scinto

(57) ABSTRACT

An electrophotographic photosensitive member, process cartridge and electrophotographic apparatus which use the same photosensitive member, and process for producing the same photosensitive member. The electrophotographic photosensitive member, includes a support and photosensitive layer thereon, wherein said photosensitive layer contains at least one of a hole-transporting compound with two or more chain-polymerizing functional groups in the same molecule and the compound hardened by polymerizing or cross-linking the above hole-transporting compound.

32 Claims, 1 Drawing Sheet

FIGURE
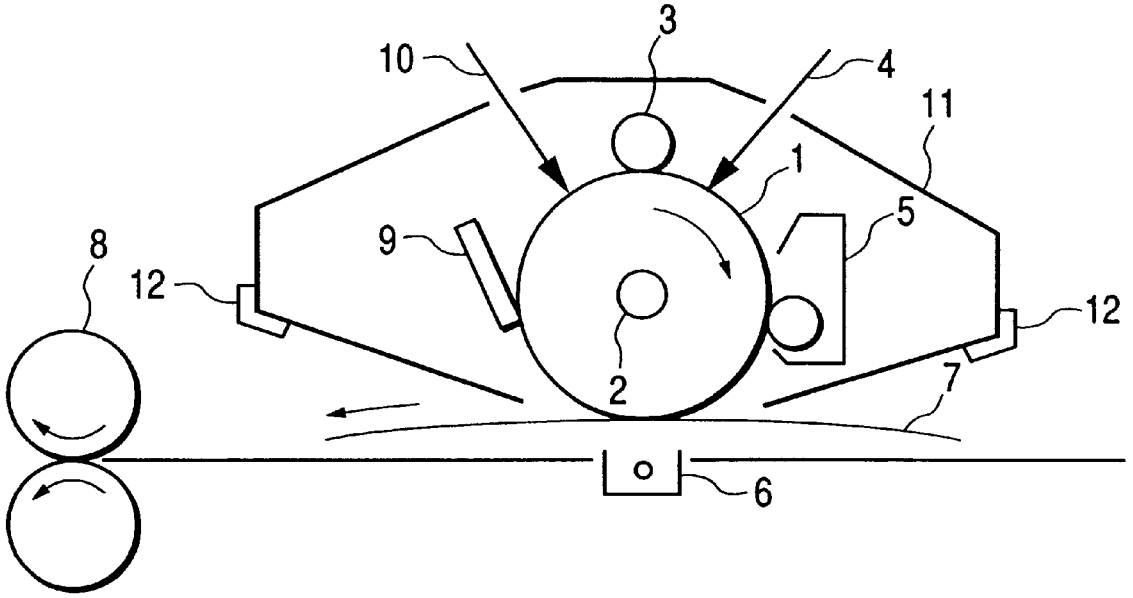

ELECTROPHOTOGRAPHIC PHOTOSENSITIVE MEMBER, PROCESS CARTRIDGE AND ELECTROPHOTOGRAPHIC APPARATUS, AND PROCESS FOR PRODUCING THE SAME PHOTOSENSITIVE MEMBER

BACKGROUND OF THE INVENTION

1. Field of the Invention

The present invention relates to an electrophotographic photosensitive member, process cartridge and electrophotographic apparatus which use the same photosensitive member, and process for producing the same photosensitive member, more particularly to the photosensitive member having a photosensitive layer containing a specific compound, process cartridge and electrophotographic apparatus which use the same photosensitive member, and process for producing the same photosensitive member.

2. Related Background Art

Inorganic materials, e.g., selenium, cadmium sulfide and zinc oxide, are known as the photoconductive materials for employing electrophotographic photosensitive members. On the other hand, organic materials, e.g., polyvinyl carbazole, phthalocyanine and azo-based pigments, have been widely used because of their advantages of, e.g., high productivity and being less polluting environments, in spite of their inferiority to inorganic materials in, e.g., photoconductive characteristics and durability.

These electrophotographic photosensitive members are frequently of a function-separated type, which is laminated with the separate charge-generating and charge-transporting layers, in order to simultaneously satisfy the required electric and mechanical properties. It is needless to say that an electrophotographic photosensitive member is required to have sufficient sensitivity, electric properties and optical properties for the electrophotographic process to which it is applied. Moreover, it is required to be sufficiently resistant to various external electric and mechanical forces generated during the various steps, e.g., electrification, exposure, toner development, transferring images to paper and cleaning, which will be applied to the surface of the photosensitive member for repeated use.

Concretely, it is required to be resistant to surface wear and scratching caused by an object coming into contact with the surface, to surface deterioration caused by electrification, e.g., decreased transfer efficiency and slip characteristics, and to electrical deterioration, e.g., decreased sensitivity and potential.

The surface layer for electrophotographic photosensitive members of organic photoconductive materials is generally a thin layer of resin, and its functions are largely determined by properties of the resin. Recently, acrylic resin, polycarbonate resin and the like are used as the ones which can satisfy the above requirements to some extent. However, none of these resins can simultaneously satisfy all of the above requirements. In particular, their insufficient hardness is one of the largest problems to be solved for further improving durability of the photosensitive members. The surface layer, even when the above resin is used therefor, will be worn or damaged when used repeatedly.

Recently, low-molecular-weight compounds, e.g., charge-transporting compounds, are frequently used in large quantities to satisfy the requirements for higher sensitivity. However, strength of films of such compounds will be greatly decreased, because of their plasticizing functions, aggravating wear and/or scratching-caused damages of the surface layer when it is repeatedly used. Another type of possible problems resulting from use of such compounds is tendency of these compounds to separation while the electrophotographic photosensitive member is stored.

One of the means proposed to solve these problems is use of a settable resin for the charge-transporting layer, as disclosed by, e.g., Japanese Patent Application Laid-Open No. 2-127652. Such a resin will greatly improve resistance of the charge-transporting layer to cracking and damages when used repeatedly by promoting hardening and cross-linking of the layer.

It should be noted, however, that a low-molecular-weight compound inherently works as a plasticizer in the binder resin, even when a settable resin is used, and will not drastically improve the above-mentioned problems resulting from separation. In a charge-transporting layer composed of an organic charge-transporting material and binder resin, its charge-transporting capacity largely depends on properties of the resin, by which is meant that it is difficult to sufficiently satisfy the requirements of high hardness and electrophotographic characteristics simultaneously, because, for example, a settable resin of sufficiently high hardness tends to decrease the charge-transporting capacity, to possibly increase residual potential when the member is repeatedly used.

For example, Japanese Patent Application Laid-Open Nos. 5-216249 and 7-72640 disclose an electrophotographic photosensitive member with a charge-transporting layer containing a monomer with carbon-carbon double bond, where the double bond works as the charge-transporting agent, when excited by heat or light energy. However, the charge-transporting agent is merely attached to the main skeleton of the polymer like a pendant, difficult to sufficiently improve mechanical strength because of insufficient removal of the above-mentioned plasticizing function. Increasing concentration of the charge-transporting material in an attempt to improve the charge-transporting capacity decreases cross-linking density, leading to insufficient mechanical strength. This may also cause adverse effects of necessary additives for polymerization, e.g., initiator, on the electrophotographic characteristics.

As another means to solve the above problems, Japanese Patent Application Laid-Open No. 8-248649 discloses an electrophotographic photosensitive member whose charge-transporting layer is composed of a thermoplastic resin with a group having charge-transporting capacity in the main skeleton. This charge-transporting layer is more resistant to the separation and mechanically stronger than the conventional, molecule-dispersion type layer. However, improvement of strength is limited, when a thermoplastic resin is used, and handling and productivity-related characteristics of the member, including solubility of the resin, are not sufficient.

Therefore, there are demands for the photosensitive members which can simultaneously satisfy the requirements for mechanical strength and charge-transporting capacity to a higher extent.

SUMMARY OF THE INVENTION

It is an object of the present invention to provide an electrophotographic photosensitive member of higher resistance to wear and scratching, and also of higher resistance to the separation by solving the problems involved in the conventional electrophotographic photosensitive member to increase film strength.

It is another object of the present invention to provide an electrophotographic photosensitive member which shows greatly reduced changes or deterioration in photosensitive characteristics, e.g., increased residual potential, when it is repeatedly used, and secures required functions stably even when it is repeatedly used.

It is still another object of the present invention to provide a process cartridge and electrophotographic apparatus which use the above electrophotographic photosensitive member.

It is yet another object of the present invention to provide a process for producing the above electrophotographic photosensitive member.

More concretely, the present invention provides an electrophotographic photosensitive member, comprising a support and photosensitive layer thereon, wherein said photosensitive layer contains at least one of a hole-transporting compound with two or more chain-polymerizing functional groups in the same molecule and the compound hardened by polymerizing or cross-linking the above hole-transporting compound.

The present invention also provides a process cartridge comprising an electrophotographic photosensitive member and at least one of the means selected from the group consisting of those for electrification, development and cleaning, which are monolithically supported to form an assembly freely attachable to or detachable from an electrophotographic apparatus body, said electrophotographic photosensitive member comprising a support and photosensitive layer thereon, wherein said photosensitive layer contains at least one of a hole-transporting compound with two or more chain-polymerizing functional groups in the same molecule and the compound hardened by polymerizing or cross-linking the above hole-transporting compound.

The present invention also provides an electrophotographic apparatus comprising an electrophotographic photosensitive member, and means for electrification, exposure, development and transferring, said electrophotographic photosensitive member comprising a support and photosensitive layer thereon, wherein said photosensitive layer contains at least one of a hole-transporting compound with two or more chain-polymerizing functional groups in the same molecule and the compound hardened by polymerizing or cross-linking the above hole-transporting compound.

The present invention also provides a process for producing an electrophotographic photosensitive member which has a support and photosensitive layer thereon, comprising a step for forming a photosensitive layer for said electrophotographic photosensitive member, wherein said step hardens a hole-transporting compound with two or more chain-polymerizing functional groups in the same molecule by polymerization or cross-linking.

BRIEF DESCRIPTION OF THE DRAWING

FIGURE illustrates constitution of the electrophotographic apparatus equipped with the process cartridge having the electrophotographic photosensitive member of the present invention.

DETAILED DESCRIPTION OF THE PREFERRED EMBODIMENTS

The electrophotographic photosensitive member of the present invention comprises at least one of a hole-transporting compound with two or more chain-polymerizing functional groups in the same molecule and the compound hardened by polymerizing or cross-linking the above hole-transporting compound.

The reactions for forming polymers fall into general categories of chain polymerization and stepwise polymerization, and mode of the polymerization for the present invention belongs to the former category. More specifically, the chain polymerizations include polymerization of unsaturated groups, ring-opening polymerization and isomerization polymerization in which the reaction proceeds mainly via an intermediate, e.g., radicals and ions (refer to, e.g., "Chemistry of Basic Synthesis Resins (a new edition)," by Tadahiro Miwa, published by Giho-do Shuppan, p. 24, Jul. 25, 1995 (first edition, 8th impression)).

The chain-polymerizing functional group is the one capable of proceeding the chain polymerization. The functional groups for polymerization of unsaturated groups and ring-opening polymerization are described below. They account for most of the chain-polymerizing functional groups and have wide applications.

Polymerization of unsaturated groups is one mode of polymerization in which one or more unsaturated groups, e.g., C=C, C=C, C=O, C=N and C≡N, mainly C=C, react each other by radicals or ions. These unsaturated polymerizable functional groups include, but not limited to, the following groups:

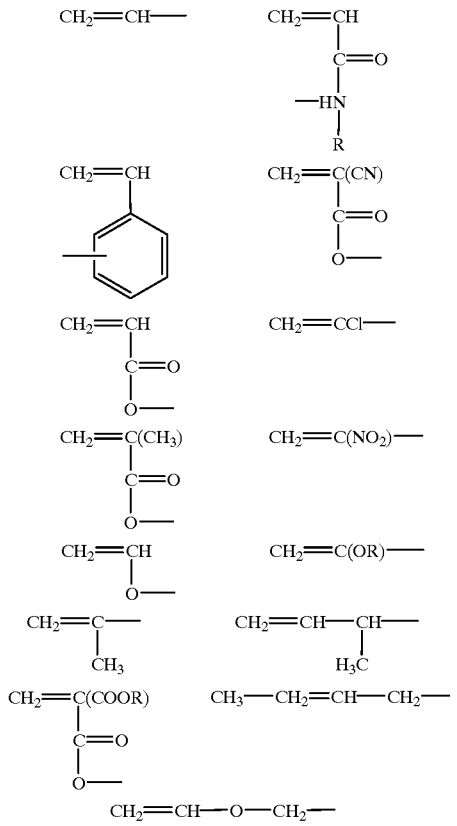

wherein, R is an alkyl group, e.g., methyl, ethyl or propyl, which may have a substituent; aralkyl group, e.g., benzyl or phenethyl, which may have a substituent; aryl group, e.g., phenyl, naphthyl or anthryl, which may have a substituent; hydrogen atom; or the like.

Ring-opening polymerization is a reaction in which an unstable ring-structure having a strain, e.g., carbon ring, oxo ring and nitrogen-containing hetero ring, is activated and opened by the action of a catalyst, and, at the same time, polymerization reaction is repeated to form a chain-shaped polymer. An ion basically works as the active species in most of these reactions. The functional groups for ring-opening polymerization include, but not limited to, the following groups:

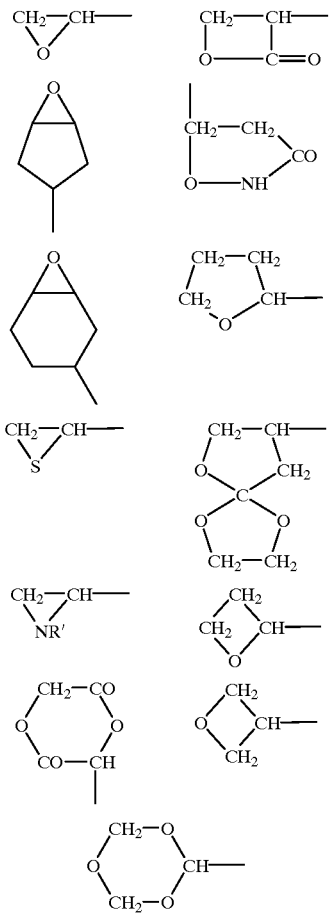

wherein, R' is an alkyl group, e.g., methyl, ethyl or propyl, which may have a substituent; aralkyl group, e.g., benzyl or phenethyl, which may have a substituent; aryl group, e.g., phenyl, naphthyl or anthryl, which may have a substituent; hydrogen atom; or the like.

Of the above chain-polymerizing functional groups useful for the present invention, the ones shown by the following general formulae (5) to (7) are preferable.

(5)

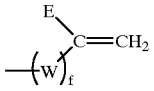

wherein, E is hydrogen atom; a halogen atom, e.g., fluorine, chlorine or bromine; alkyl group, e.g., methyl, ethyl, propyl or butyl, which may have a substituent; aralkyl group, e.g., benzyl, phenethyl, naphthylmethyl, furfuryl or thienyl, which may have a substituent; aryl group, e.g., phenyl, naphthyl, anthryl, pyrenyl, thiophenyl or furyl, which may have a substituent; CN; nitro; alkoxy group, e.g., methoxy, ethoxy or propoxy; or —COOR$^7$ or CONR$^8$R$^9$, W is a divalent arylene group, e.g., phenylene, naphthylene or anthracenylene, which may have a substituent; divalent alkylene group, e.g., methylene, ethylene or butylene, which may have a substituent; or —COO—, —CH$_2$—, —O—, —OO—, —S— or CONR$^{10}$—, R$^7$, R$^8$, R$^9$ and R$^{10}$ are each hydrogen atom; a halogen atom, e.g., fluorine, chlorine or bromine; alkyl group, e.g., methyl, ethyl or propyl, which may have a substituent; aralkyl group, e.g., benzyl or phenethyl, which may have a substituent; or aryl group, e.g., phenyl, naphthyl or anthryl, which may have a substituent; where R$^8$ and R$^9$ may be the same or different, and f is 0 or 1.

The substituents which E and W may have include a halogen atom, e.g., fluorine, chlorine, bromine and iodine; nitro group; cyano group; hydroxy group; alkyl group, e.g., methyl, ethyl, propyl and butyl; alkoxy group, e.g., methoxy, ethoxy and propoxy; aryloxy group, e.g., phenoxy and naphthoxy; aralkyl group, e.g., benzyl, phenethyl, naphthylmethyl, furfuryl and thienyl; and aryl group, e.g., phenyl, naphthyl, anthryl and pyrenyl.

(6)

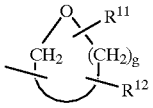

wherein, R$^{11}$ and R$^{12}$ are each hydrogen atom; an alkyl group, e.g., methyl, ethyl, propyl or butyl, which may have a substituent; aralkyl group, e.g., benzyl or phenethyl, which may have a substituent; or aryl group, e.g., phenyl or naphthyl, which may have a substituent; and g is an integer of 1 to 10.

(7)

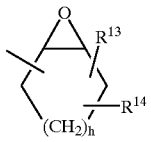

wherein, R$^{13}$ and R$^{14}$ are each hydrogen atom; an alkyl group, e.g., methyl, ethyl, propyl or butyl, which may have a substituent; aralkyl group, e.g., benzyl or phenethyl, which may have a substituent; or aryl group, e.g., phenyl or naphthyl, which may have a substituent; and h is an integer of 0 to 10.

The substituents which R$^{11}$, R$^{12}$, R$^{13}$ and R$^{14}$ in the general formula (6) or (7) may have include a halogen atom, e.g., fluorine, chlorine, bromine and iodine; alkyl group, e.g., methyl, ethyl, propyl and butyl; alkoxy group, e.g., methoxy, ethoxy and propoxy; aryloxy group, e.g., phenoxy and naphthoxy; aralkyl group, e.g., benzyl, phenethyl, naphthylmethyl, furfuryl and thienyl; and aryl group, e.g., phenyl, naphthyl, anthryl and pyrenyl.

Of the preferable chain-polymerizing functional groups for the present invention, shown by the general formulae (5) to (7), the ones shown by the following general formula (8) to (14) are more preferable:

(8)

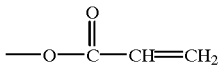

(9)

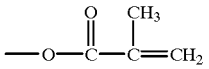

(10)

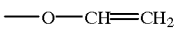

(11)

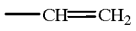

(12)

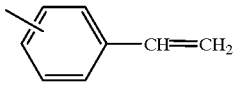

(13)

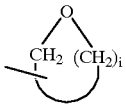

wherein i is an integer of 1 to 3

(14)

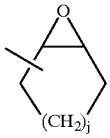

wherein j is an integer of 1 to 3

Of the groups shown by the general formulae (8) to (14), acryloyloxy group shown by the general formula (8) and methacryloyloxy group shown by the general formula (9) are still more preferable, because of their polymerization-related characteristics, among others.

The "hole-transporting compound with two or more chain-polymerizing functional groups in the same molecule" for the present invention is the compound in which at least two chain-polymerizing groups described above are bound as the functional groups to a hole-transporting compound through chemical bonds, where "two or more chain-polymerizing functional groups" may be the same or different.

The hole-transporting compounds with two or more chain-polymerizing functional groups are preferably those shown by the following general formula (1):

(1)

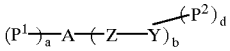

wherein, $P^1$ and $P^2$ are each a chain-polymerizing functional group, and may be the same or different; Z is an organic residue which may have a substituent; Y is hydrogen atom; and a, b and d are each an integer of 0 or more, where b+d is an integer of 3 or more when a is zero, a is an integer of 2 or more when b or d is zero, and a+b+d is an integer of 3 or more in all other cases; $P^1$ may be the same or different when a is 2 or more, $P^2$ may be the same or different when d is 2 or more, and Z may be the same or different when b is 2 or more.

The sentence "$P^1$ may be the same or different when a is 2 or more" means that, when different $P^1$ of n kinds are represented by $P^{11}$, $P^{12}$, $P^{13}$, $P^{14}$, $P^{15}$ . . . $P^{1n}$ and a is 3, the three chain-polymerizing functional groups $P^1$ directly bound to a hole-transporting compound A may be the same, two may be the same and the other different (e.g., $P^{11}$, $P^{11}$ and $P^{12}$), or all of the three groups may be different from each other (e.g., $P^{12}$, $P^{15}$ and $P^{17}$). The sentences "$P^2$ may be the same or different when d is 2 or more," and "Z may be the same or different when b is 2 or more" should be read in a similar manner.

"A" in the general formula (1) represents a hole-transporting group, and is not limited so long as it shows hole-transporting capacity. When the hole-transporting compound is represented by a hydrogen-added compound, i.e., $P^1$ and Z are hydrogen atom, the hole-transporting groups useful for the present invention include an oxazole derivative, oxadiazole derivative, imidazole derivative, triarylamine derivative, e.g., triphenylamine, 9-(p-diethylaminostyryl)anthracene, 1,1-bis-(4-dibenzylaminophenyl)propane, styrylanthracene, styrylpyrazoline, phenylhydrazones, thiazole derivative, triazole derivative, phenazine derivative, acridine derivative, benzofuran derivative, benzimidazole derivative, thiophene derivative, and N-phenylcarbazole derivative.

Of the above hole-transporting compounds, the preferable ones are shown by the general formula (4):

(4)

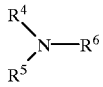

wherein, $R^4$, $R^5$ and $R^6$ are each an alkyl group having a carbon number of 1 to 10, e.g., methyl, ethyl, propyl or butyl, which may have a substituent; aralkyl group, e.g., benzyl, phenethyl, naphthylmethyl, furfuryl or thienyl, which may have a substituent; or aryl group, e.g., phenyl, naphthyl, anthryl, phenanthryl, pyrenyl, thiophenyl, furyl, pyridyl, quinolyl, benzoquinolyl, carbazolyl, phenothiazinyl, benzofuryl, benzothiophenyl, dibenzofuryl or dibenzothiophenyl, which may have a substituent.

$R^4$, $R^5$ and $R^6$ may be the same or different, and at least two of them are aryl groups. All of $R^4$, $R^5$ and $R^6$ are particularly preferably aryl groups. Two of $R^4$, $R^5$ and $R^6$ in the above general formula (4) may be bonded to each other directly or via a bonding group, the bonding groups including an alkylene group, e.g., methylene, ethylene and propylene; hetero atom, e.g., oxygen atom and sulfur atom; and CH═CH.

Z in the general formula (1) is an alkylene group which may have a substituent; arylene group which may have a substituent; $CR^1{=}CR^2$ (wherein $R^1$ and $R^2$ are each an alkyl group, aryl group, or hydrogen atom, and may be the same or different); C═O, S═O, $SO_2$, or organic residue containing at least one of oxygen and sulfur atoms, which may be arbitrarily combined with each other. Of these, the ones shown by the following general formula (2) are preferable, and those shown by the general formula (3) are more preferable.

$$-(X^1)_p-(Ar^1)_q-(X^2)_r-(Ar^2)_s-(X^3)_t- \quad (2)$$

$$-(X^4)_u-(A^3)_v-(X^5)_w- \quad (3)$$

wherein, $X^1$ to $X^3$ are each an alkylene group having a carbon number of 1 to 20, e.g., methylene, ethylene or propylene, which may have a substituent, $(CR^1{=}CR^2)m$, C=O, S=O, $SO_2$, or oxygen or sulfur atom. $Ar^1$ and $Ar^2$ are each a divalent arylene group which may have a substituent (the group formed by taking two hydrogen atoms from phenylene, naphthalene, anthracene, phenanthrene, pyrene, benzothiophene, pyridine, quinoline, benzoquinoline, carbazole, phenothiazine, benzofuran, benzothiophene, dibenzofuran, dibenzothiophene, or the like).

$R^1$ and $R^2$ are each an alkyl group, e.g., methyl, ethyl or propyl, which may have a substituent; aryl group, e.g., phenyl, naphthyl or thiophenyl, which may have a substituent; or hydrogen atom, where $R^1$ and $R^2$ may be the same or different.

m is an integer of 1 to 5, and p to t are each an integer of 0 to 10, where p to t are not simultaneously zero.

$X^4$ and $X^5$ in the general formula (3) are each $(CH_2)m'$, $(CH{=}CR^3)n'$, C=O or oxygen atom, and $Ar^3$ is a divalent arylene group which may have a substituent (the group formed by taking two hydrogen atoms from phenylene, naphthalene, anthracene, phenanthrene, pyrene, benzothiophene, pyridine, quinoline, benzoquinoline, carbazole, phenothiazine, benzofuran, benzothiophene, dibenzofuran, dibenzothiophene, or the like).

$R^3$ is an alkyl group, e.g., methyl, ethyl or propyl, which may have a substituent; aryl group, e.g., phenyl, naphthyl or thiophenyl, which may have a substituent; or hydrogen atom; m' is an integer of 1 to 10; n' is an integer of 1 to 5; and u to w are each an integer of 0 to 10 (where u to w are each particularly preferably an integer of 0 to 5), where u to w are not simultaneously zero.

The substituents which $R^1$ to $R^6$, $Ar^1$ to $Ar^3$, $X^1$ to $X^5$ and Z in the general formulae (1) to (4) may have include a halogen atom, e.g., fluorine, chlorine, bromine and iodine; nitro group; cyano group; hydroxy group; alkyl group, e.g., methyl, ethyl, propyl and butyl; alkoxy group, e.g., methoxy, ethoxy and propoxy; aryloxy group, e.g., phenoxy and naphthoxy; aralkyl group, e.g., benzyl, phenethyl, naphthylmethyl, furfuryl and thienyl; and aryl group, e.g., phenyl, naphthyl, anthryl and pyrenyl; substituted amino group, e.g., dimethylamino, diethylamino, dibenzylamino, diphenylamino and di(p-tolyl)amino; and arylvinyl group, e.g., styryl and naphthylvinyl.

The hole-transporting compound, useful for the present invention, with two or more chain-polymerizing functional groups in the same molecule preferably has an oxidation potential of 1.2 V or less, more preferably 0.4 to 1.2 V.

When the oxidation potential exceeds 1.2 V, it is difficult to inject the charge (hole) from the charge-generating material. Other problems tending to occur include increased residual potential, deteriorated sensitivity, and excessive potential changes when the photosensitive member is repeatedly used. The problems possibly occurring at an oxidation potential below 0.4 V include decreased electrification capacity, and accelerated deterioration of the compound because it is easily oxidized, which, in turn, may cause the problems, e.g., deteriorated sensitivity, blurred images, and excessive potential changes when the photosensitive member is repeatedly used. Oxidation potential can be determined by the following procedure:

Measurement of Oxidation Potential

Oxidation potential of the hole-transporting compound was determined by an analyzer with a saturated calomel reference electrode and 0.1N $(n\text{-}Bu)_4N^+ClO_4^-$ acetonitrile solution as the electrolytic solution, where the potential applied to the working electrodes of platinum was swept by a potential sweeper, to determine the oxidation potential from the peak in the current-potential curve.

More concretely, the sample was dissolved in the 0.1N $(n\text{-}Bu)_4N^+ClO_4^+$ acetonitrile solution to have a concentration of approximately 5 to 10 mmol %. A voltage was applied to the sample solution by the working electrodes in a range from 0 to 1.5 V, in which it was increased linearly to establish the current-potential curve. The potential which gave the peak current (the first peak, when two or more peaks were observed) was defined as the oxidation potential.

Some of the preferable hole-transporting compounds with two or more chain-polymerizing functional groups in the same molecule are shown below. It is to be understood that these compounds are not limited to the above.

EXEMPLARY COMPOUND

| No. | COMPOUND |
|---|---|
| 1 | 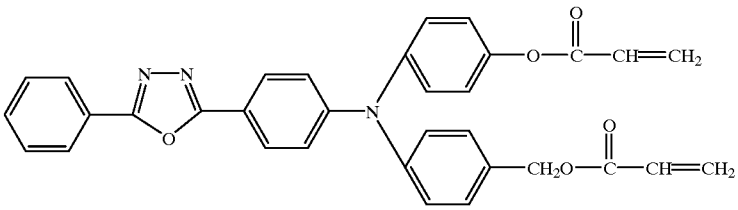 |

-continued
EXEMPLARY COMPOUND
| No. | COMPOUND |
|---|---|
| 2 | 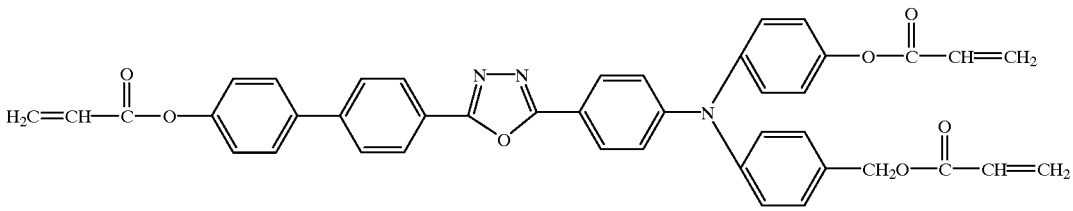 |
| 3 | 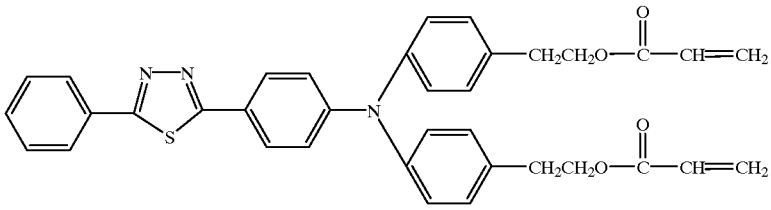 |
| 4 | 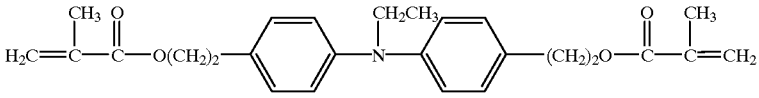 |
| 5 | 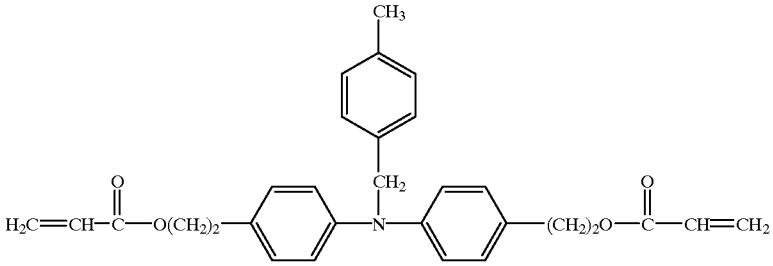 |
| 6 | 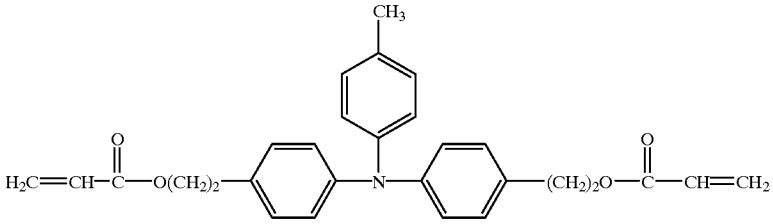 |
| 7 | 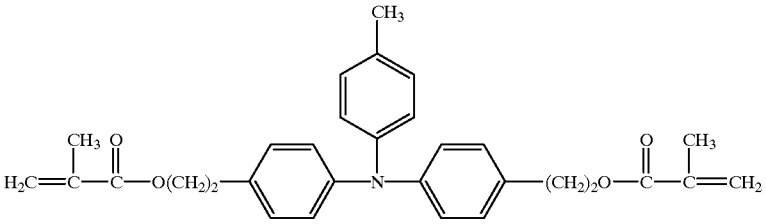 |

-continued
EXEMPLARY COMPOUND
| No. | COMPOUND |
|---|---|
| 8 | 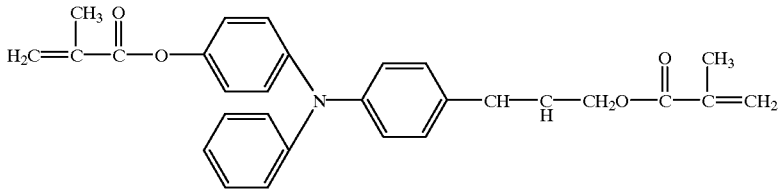 |
| 9 | 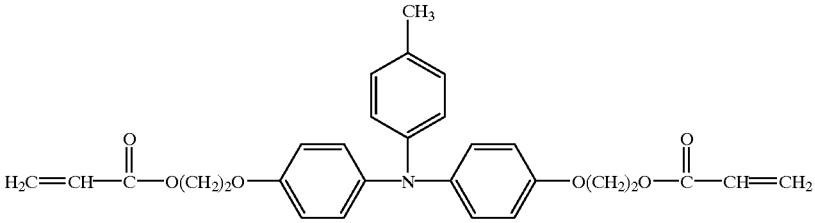 |
| 10 | 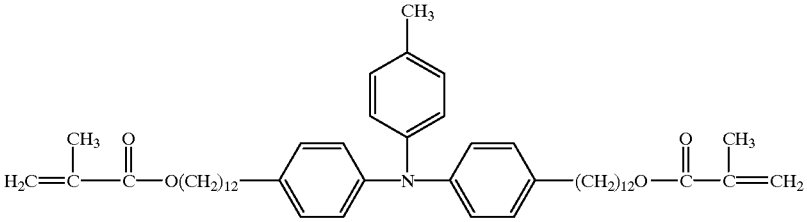 |
| 11 | 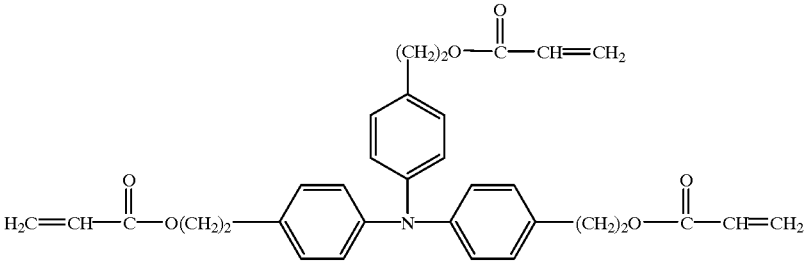 |
| 12 | 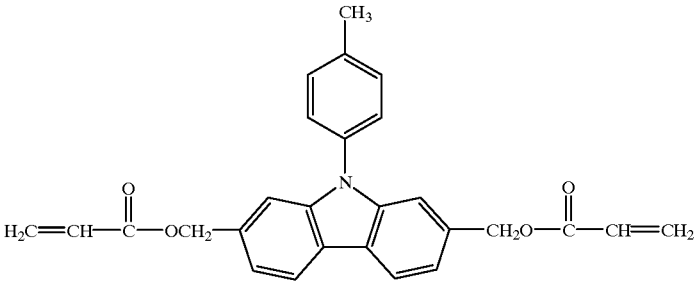 |

-continued
| No. | EXEMPLARY COMPOUND<br>COMPOUND |
|---|---|
| 13 | 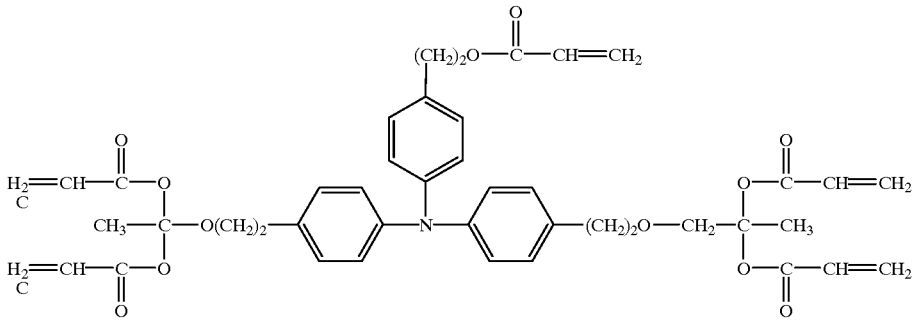 |
| 14 | 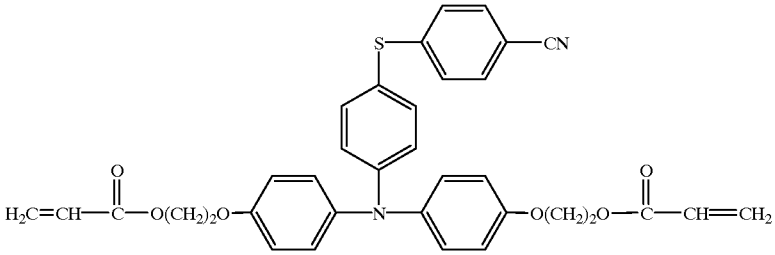 |
| 15 | 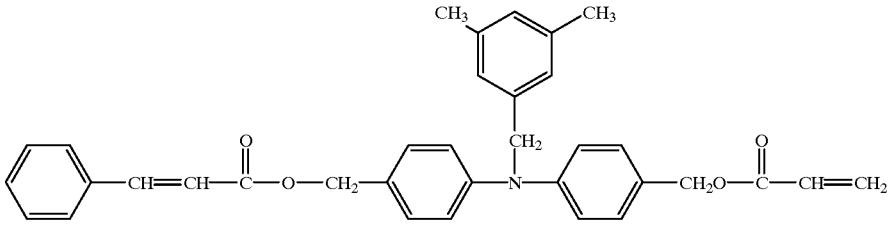 |
| 16 | 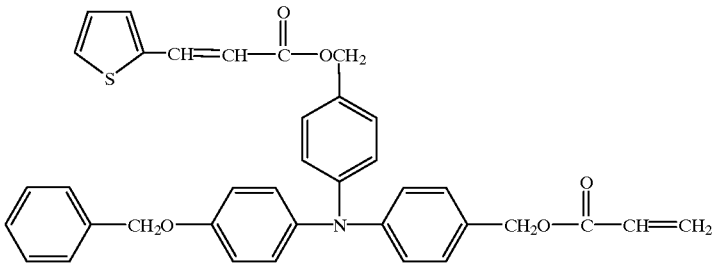 |
| 17 | 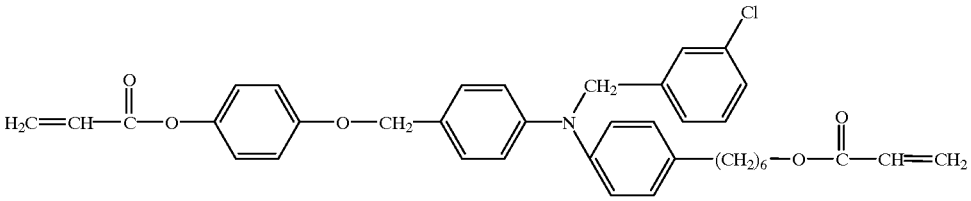 |

-continued
EXEMPLARY COMPOUND
| No. | COMPOUND |
|---|---|
| 18 | 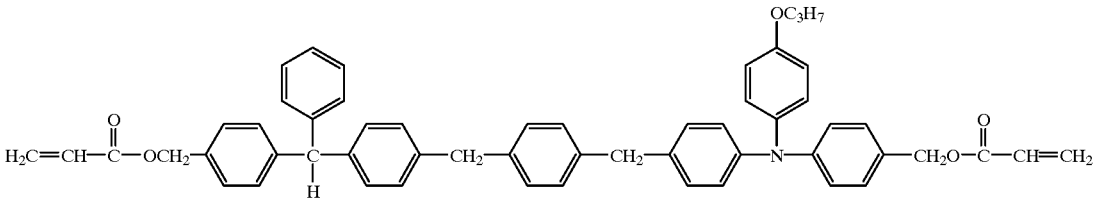 |
| 19 | 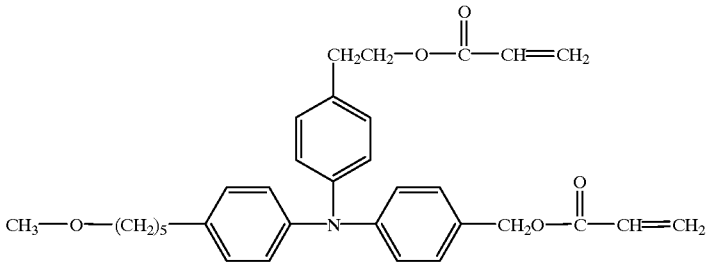 |
| 20 | 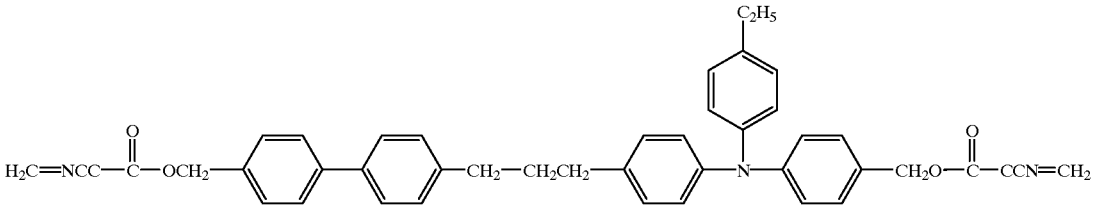 |
| 21 | 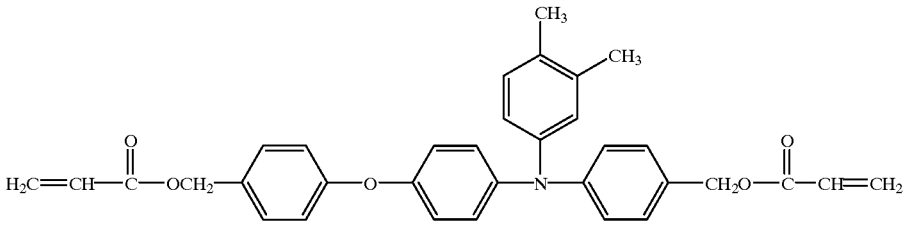 |
| 22 | 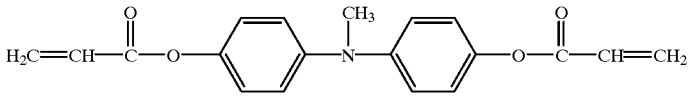 |
| 23 | 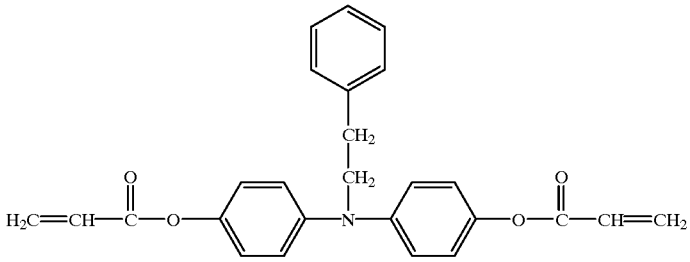 |

-continued
| EXEMPLARY COMPOUND | |
|---|---|
| No. | COMPOUND |
| 24 | 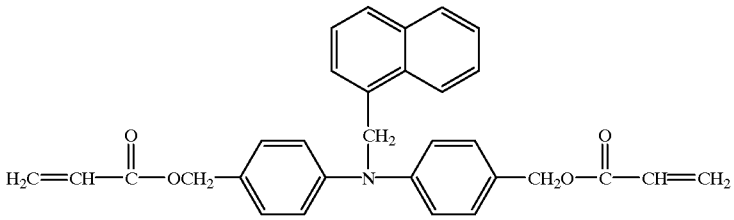 |
| 25 | 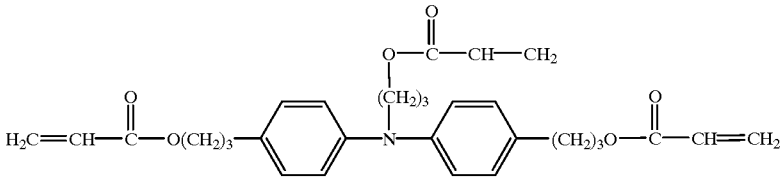 |
| 26 | 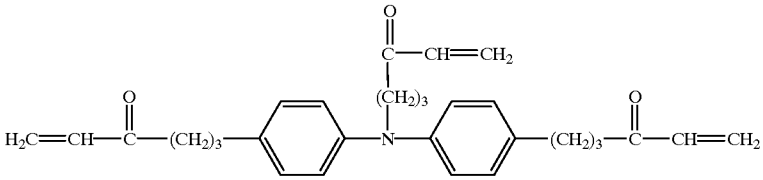 |
| 27 | 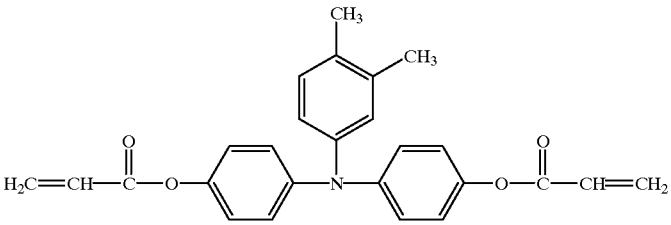 |
| 28 | 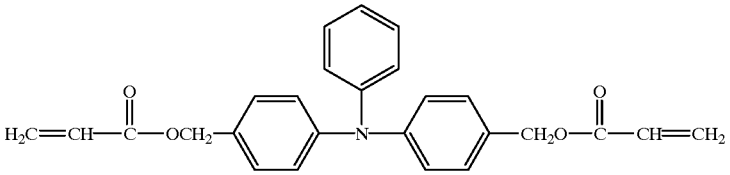 |
| 29 | 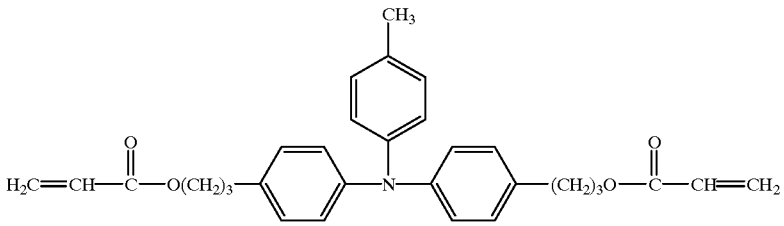 |

-continued
| EXEMPLARY COMPOUND | |
|---|---|
| No. | COMPOUND |
| 30 | 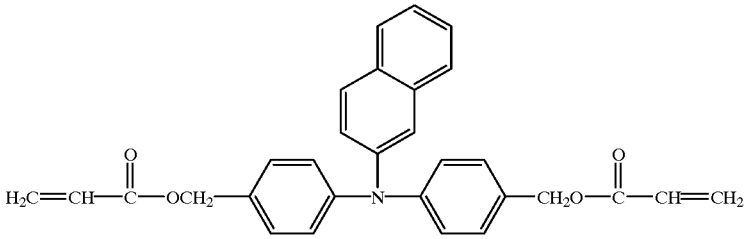 |
| 31 | 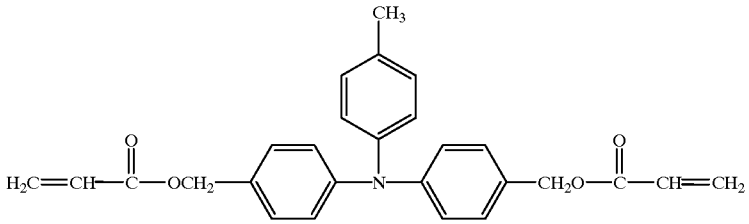 |
| 32 | 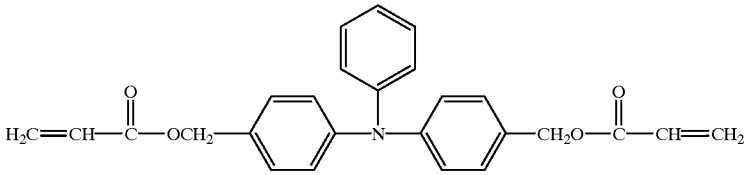 |
| 33 | 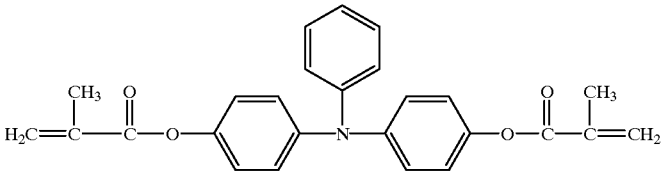 |
| 34 | 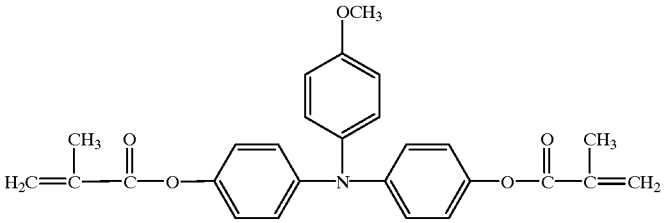 |
| 35 | 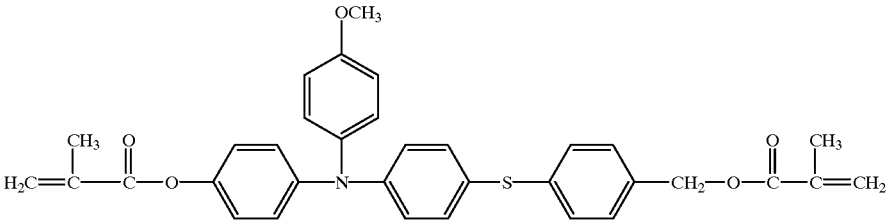 |

-continued
| No. | EXEMPLARY COMPOUND<br>COMPOUND |
|---|---|
| 36 | 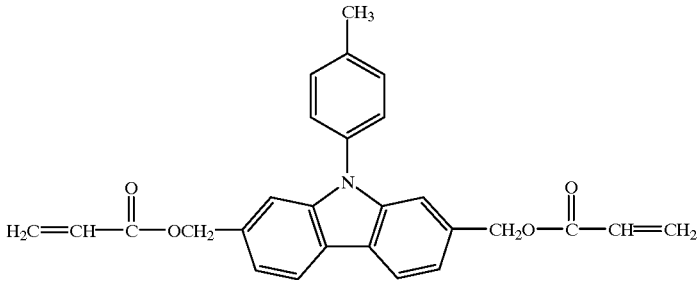 |
| 37 | 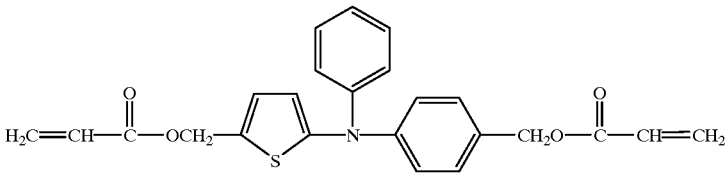 |
| 38 | 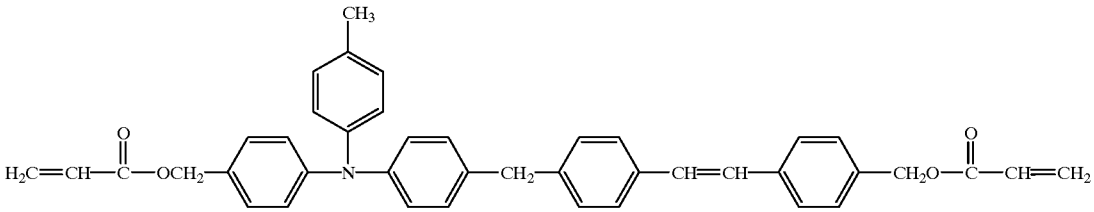 |
| 39 | 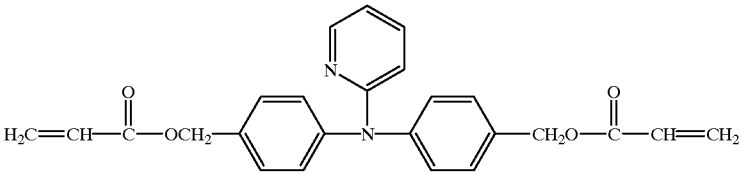 |
| 40 | 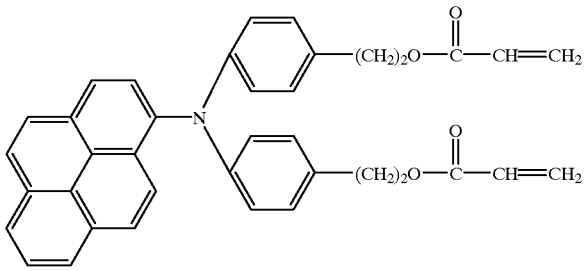 |
| 41 | 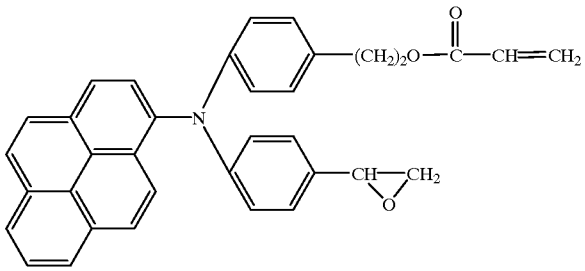 |

-continued
EXEMPLARY COMPOUND
| No. | COMPOUND |
|---|---|
| 42 | 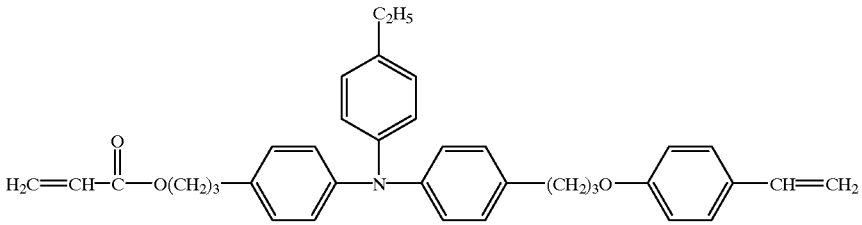 |
| 43 | 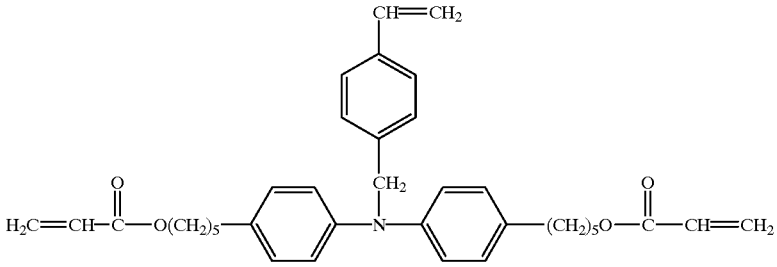 |
| 44 | 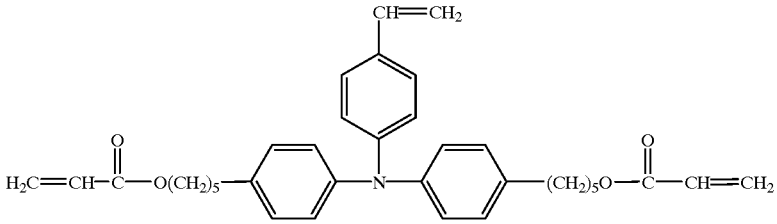 |
| 45 | 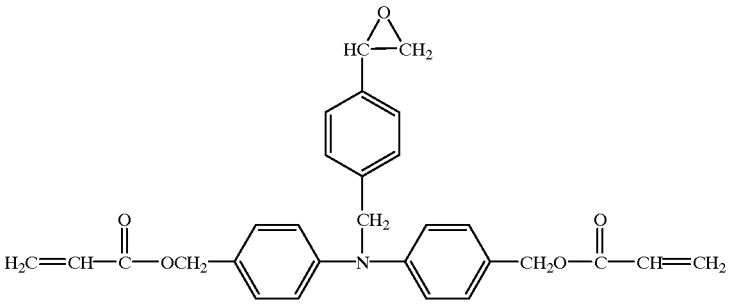 |
| 46 | 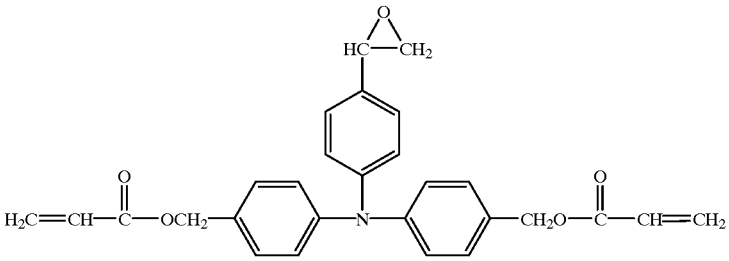 |

-continued
EXEMPLARY COMPOUND
| No. | COMPOUND |
|---|---|
| 47 | 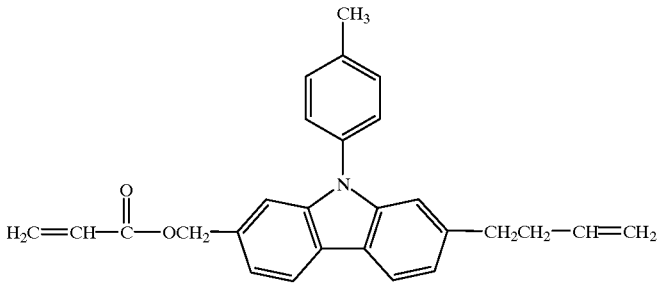 |
| 48 | 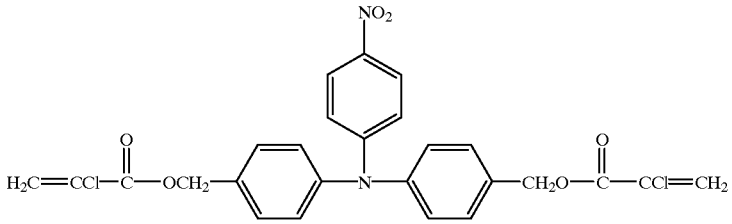 |
| 49 | 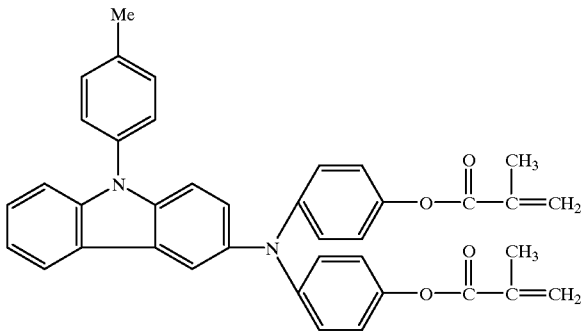 |
| 50 | 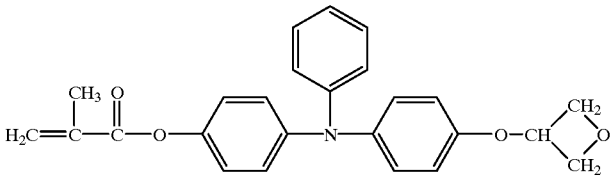 |
| 51 | 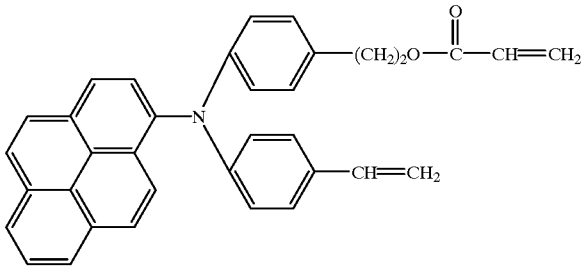 |

-continued
| No. | EXEMPLARY COMPOUND<br>COMPOUND |
|---|---|
| 52 | 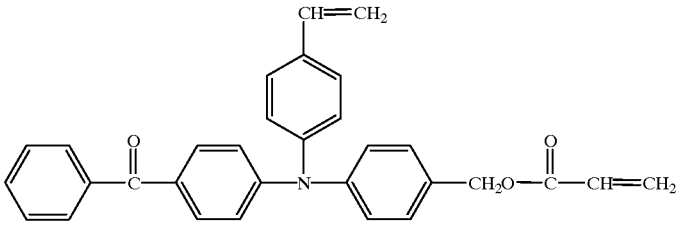 |
| 53 | 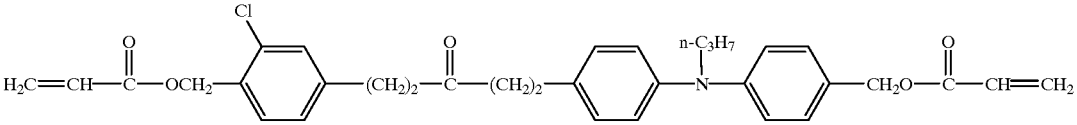 |
| 54 | 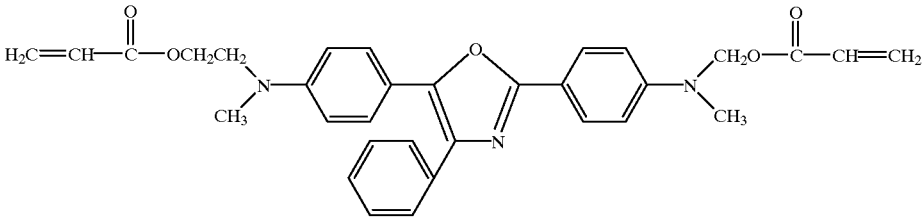 |
| 55 | 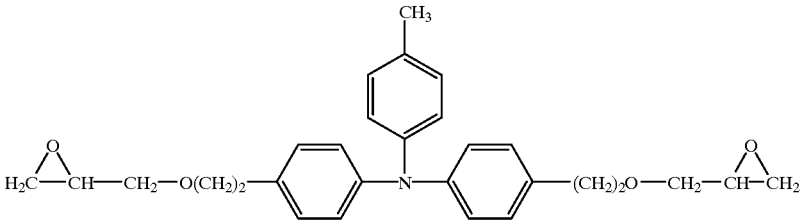 |
| 56 | 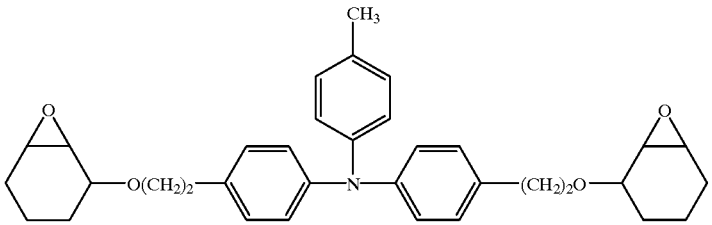 |
| 57 | 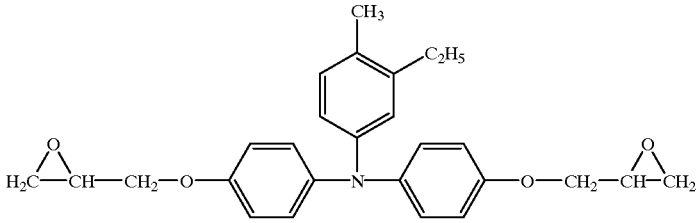 |

-continued
| EXEMPLARY COMPOUND | |
|---|---|
| No. | COMPOUND |
| 58 | 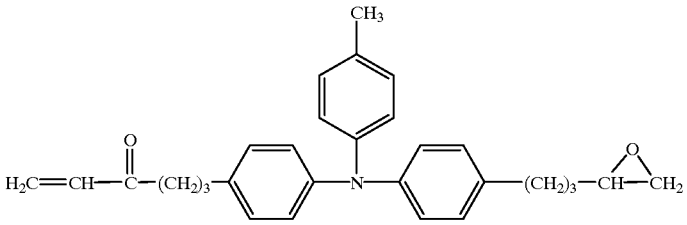 |
| 59 | 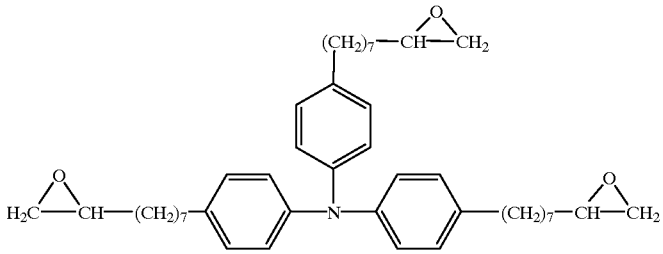 |
| 60 | 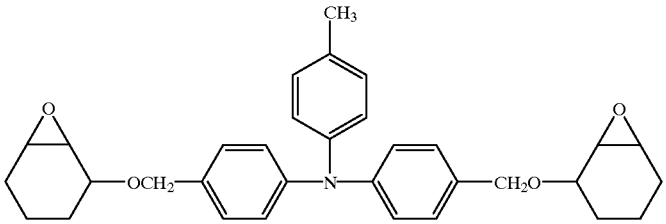 |
| 61 | 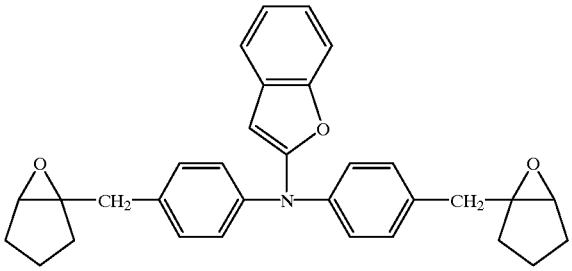 |
| 62 | 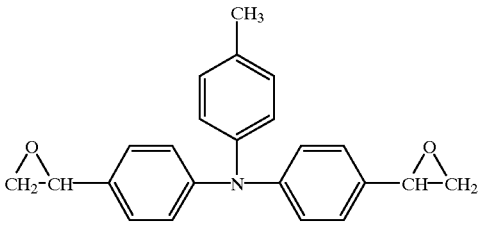 |

-continued
| No. | EXEMPLARY COMPOUND COMPOUND |
|---|---|
| 63 | 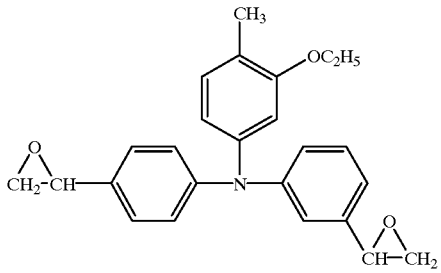 |
| 64 | 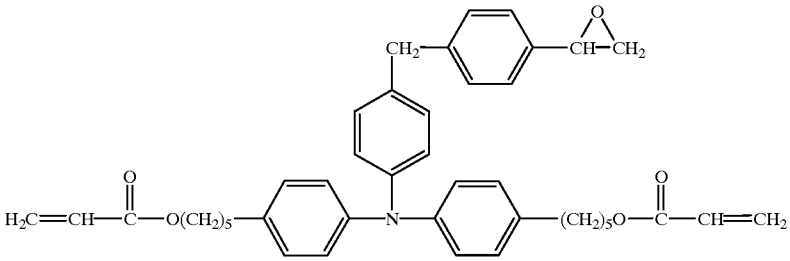 |
| 65 | 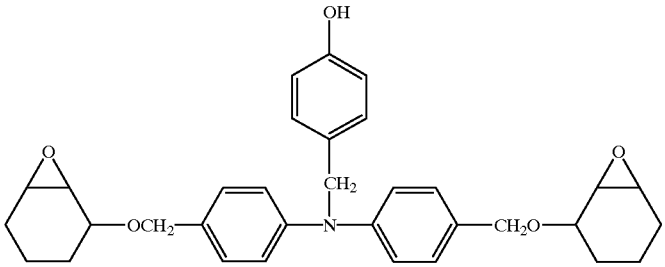 |
| 66 | 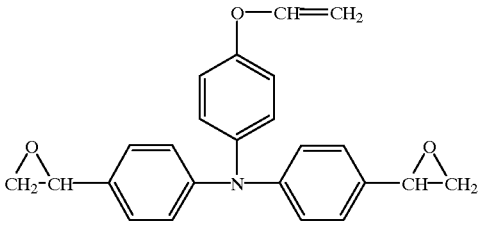 |
| 67 | 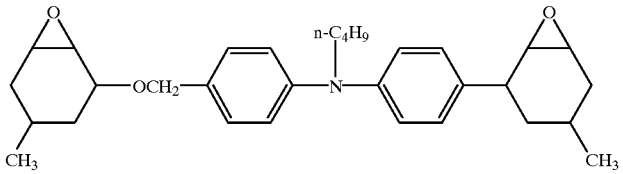 |
| 68 | 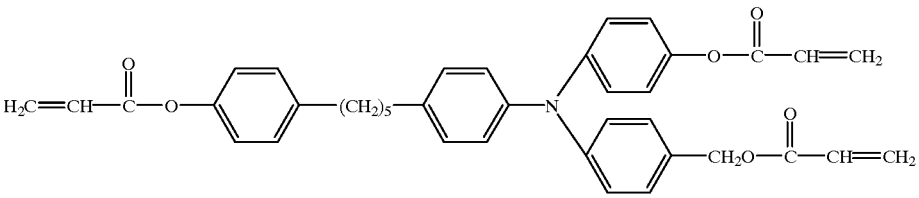 |

-continued
EXEMPLARY COMPOUND
| No. | COMPOUND |
|---|---|
| 69 | 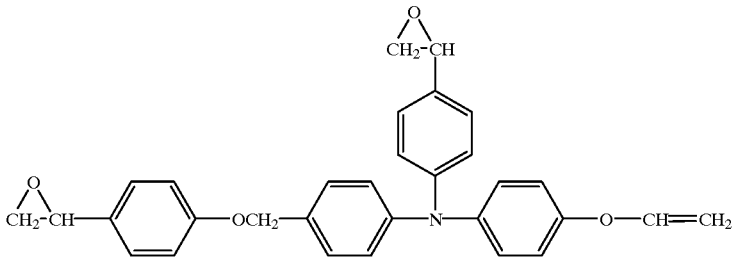 |
| 70 | 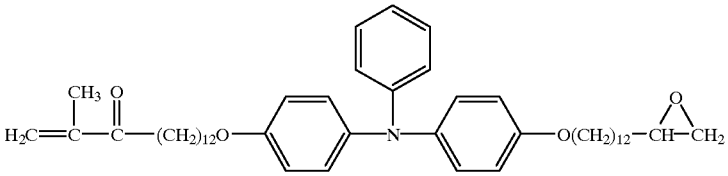 |
| 71 | 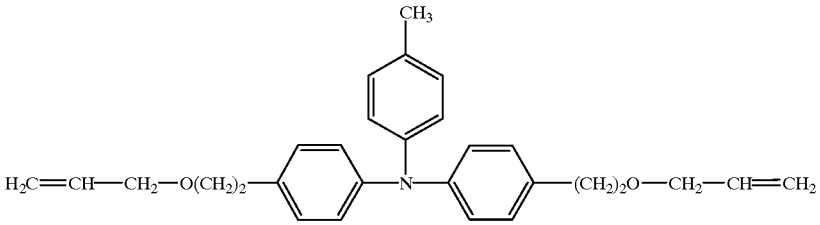 |
| 72 | 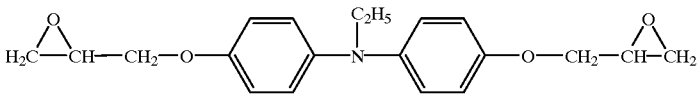 |
| 73 | 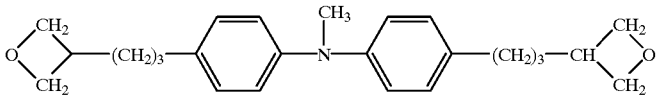 |
| 74 | 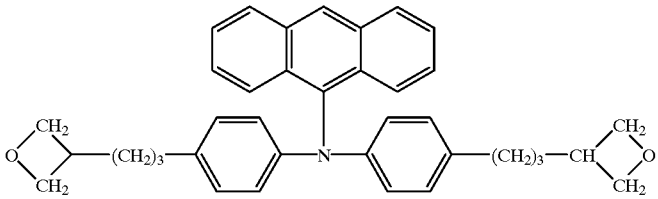 |
| 75 | 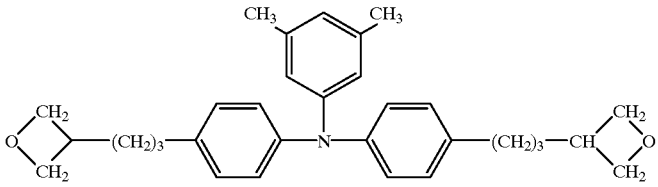 |
| 76 | 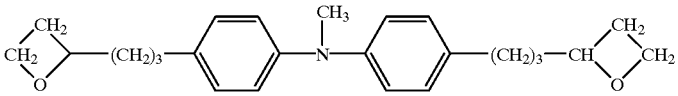 |

-continued
EXEMPLARY COMPOUND
| No. | COMPOUND |
|---|---|
| 77 | 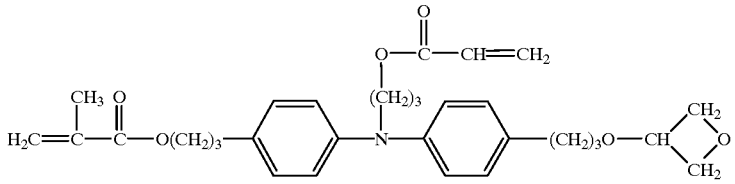 |
| 78 | 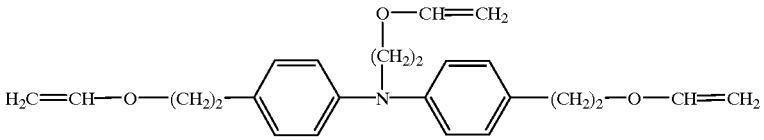 |
| 79 | 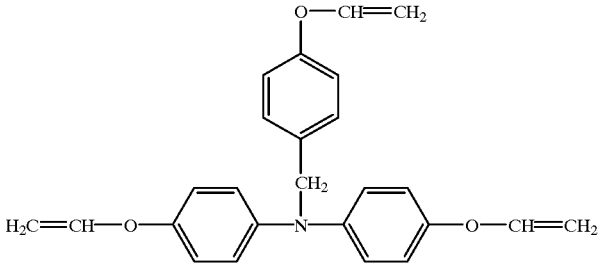 |
| 80 | 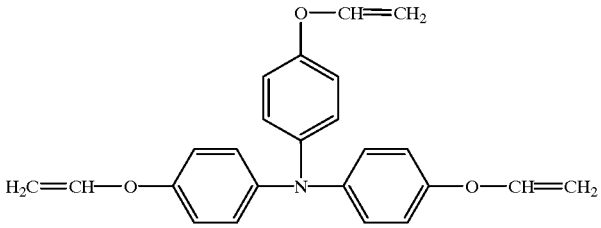 |
| 81 | 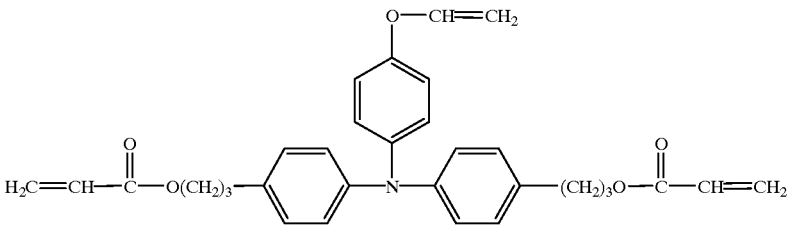 |
| 82 | 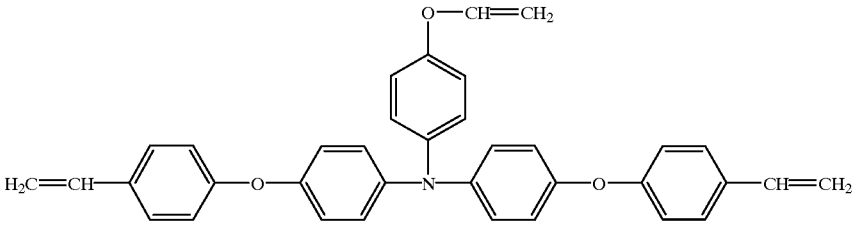 |

-continued
| No. | EXEMPLARY COMPOUND<br>COMPOUND |
|---|---|
| 83 | 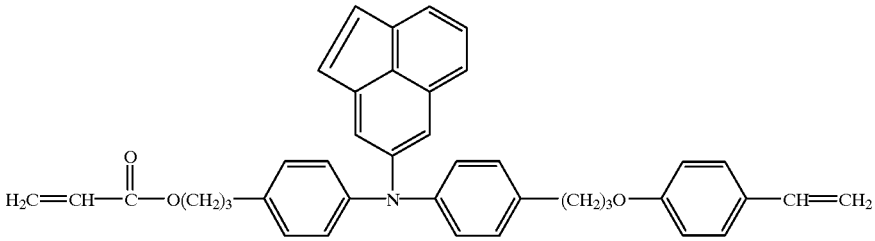 |
| 84 | 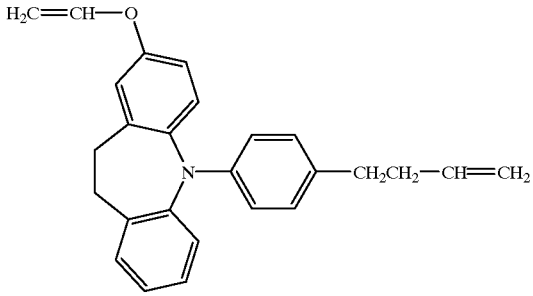 |
| 85 | 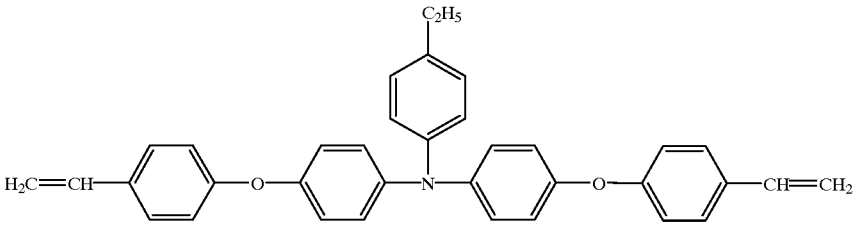 |
| 86 | 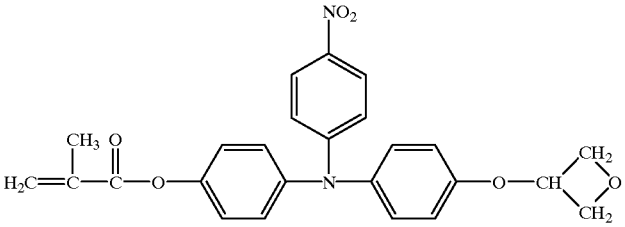 |
| 87 | 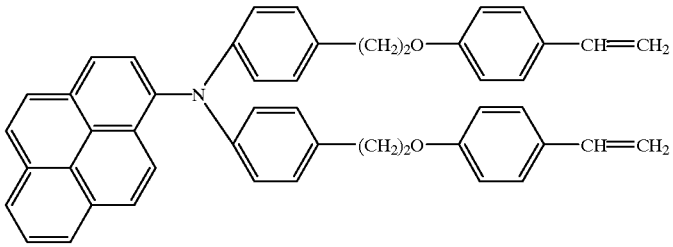 |
| 88 | 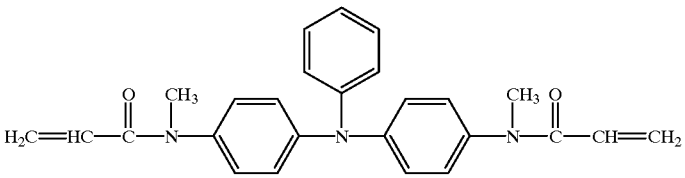 |

-continued
| No. | EXEMPLARY COMPOUND<br>COMPOUND |
|---|---|
| 89 | 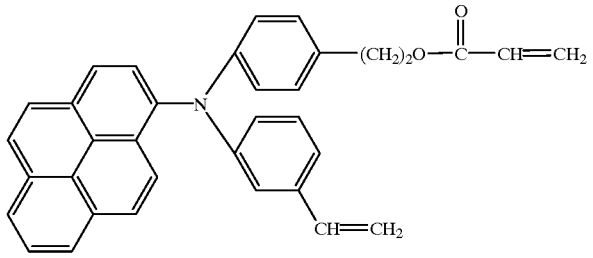 |
| 90 | 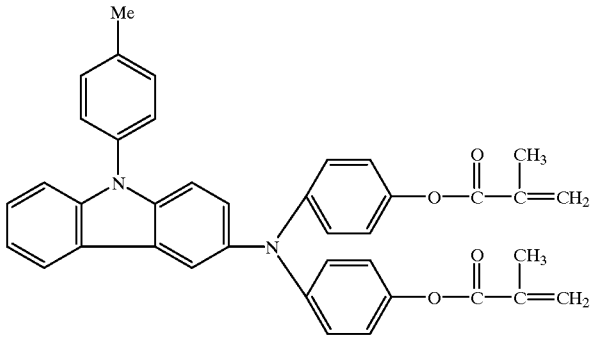 |
| 91 | 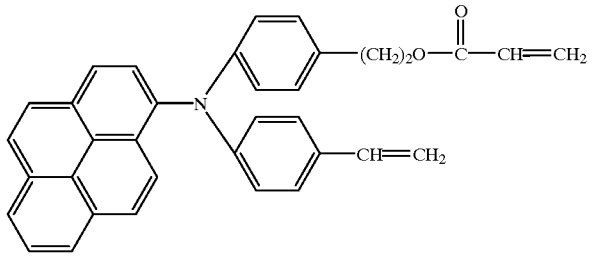 |
| 92 | 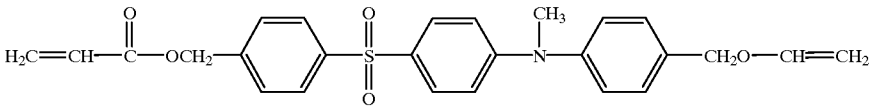 |
| 93 | 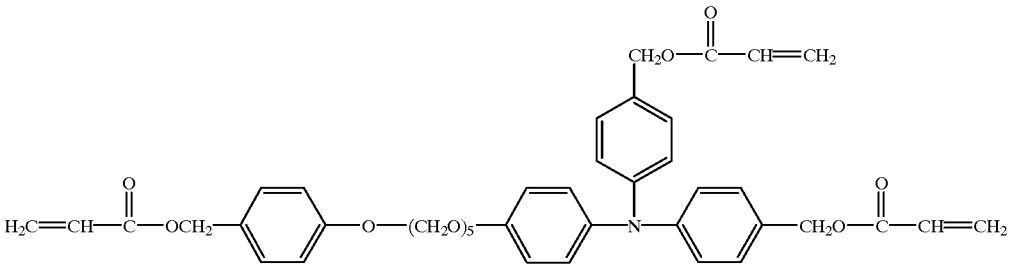 |
| 94 | 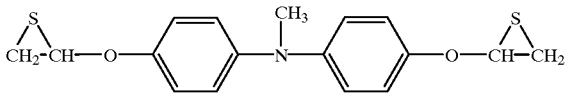 |

-continued
EXEMPLARY COMPOUND
| No. | COMPOUND |
|---|---|
| 95 | 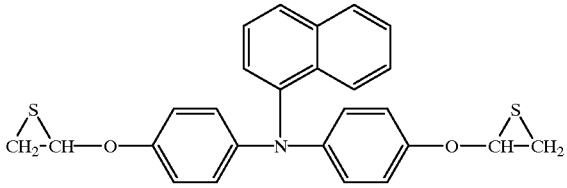 |
| 96 | 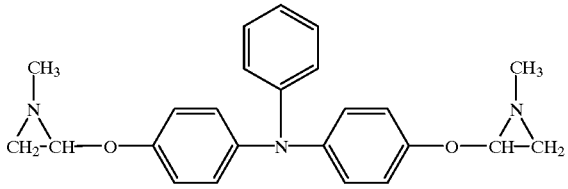 |
| 97 | 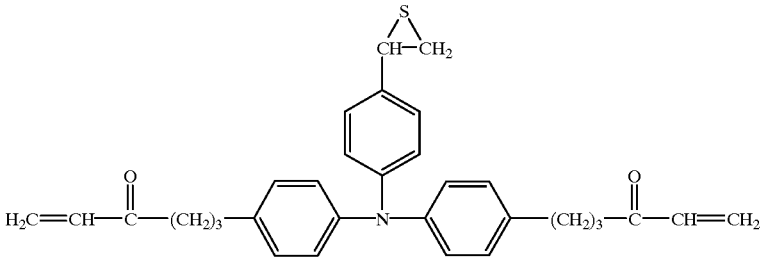 |
| 98 | 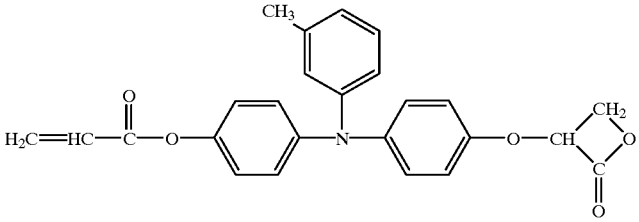 |
| 99 | 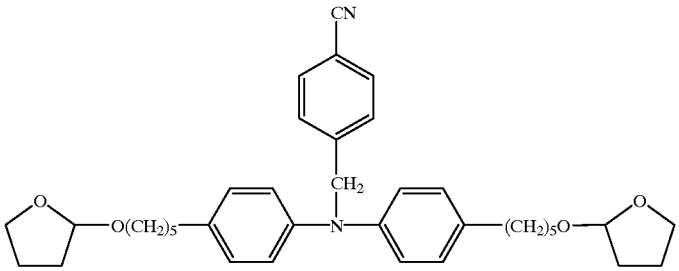 |
| 100 | 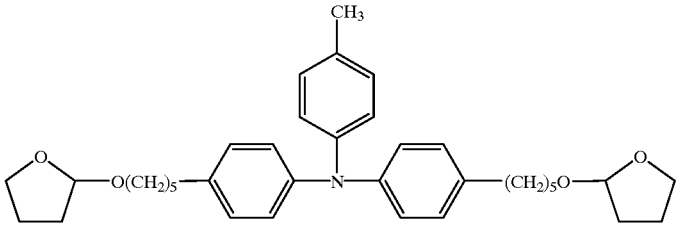 |

-continued
EXEMPLARY COMPOUND
| No. | COMPOUND |
|---|---|
| 101 | 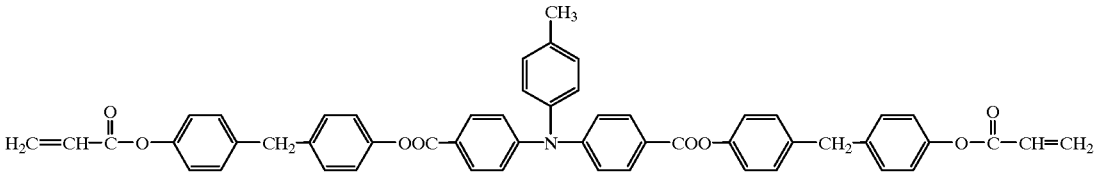 |
| 102 | 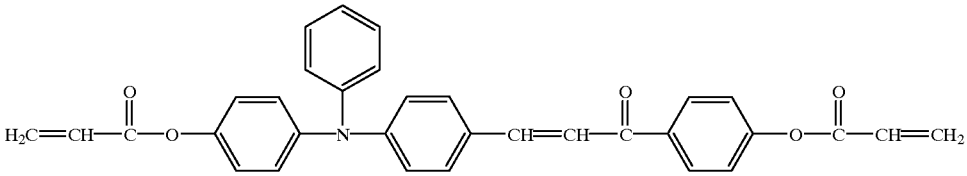 |
| 103 | 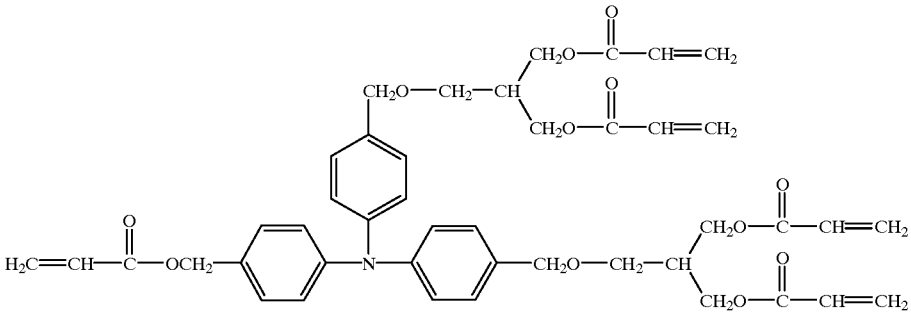 |
| 104 | 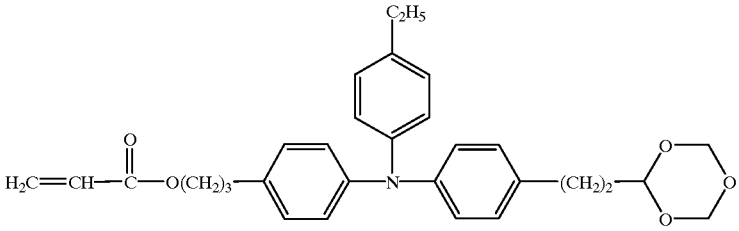 |
| 105 | 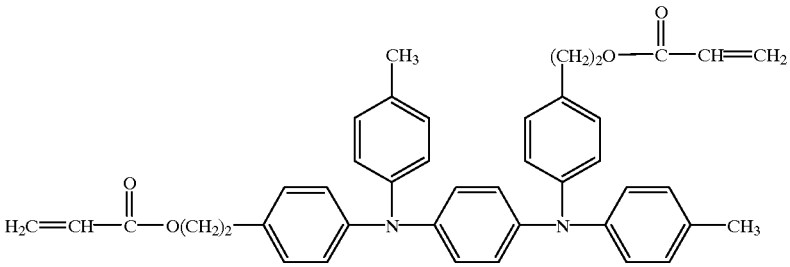 |

-continued
| EXEMPLARY COMPOUND | |
|---|---|
| No. | COMPOUND |
| 106 | 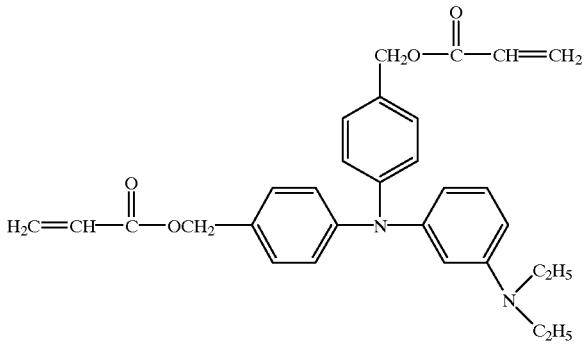 |
| 107 | 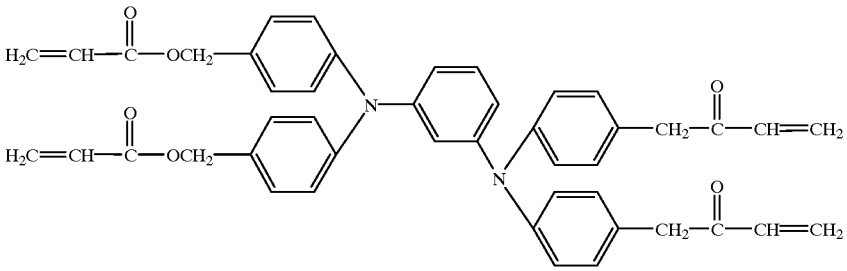 |
| 108 | 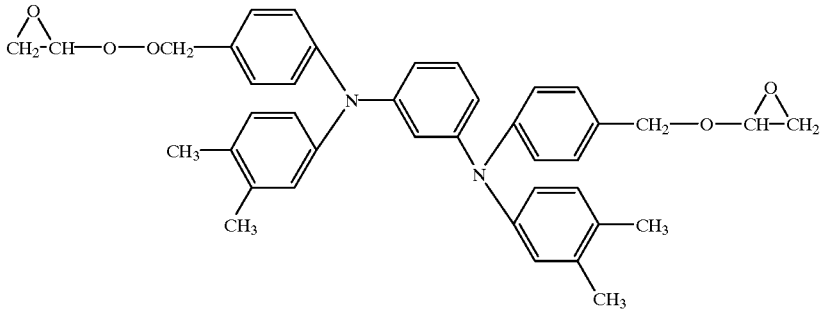 |
| 109 | 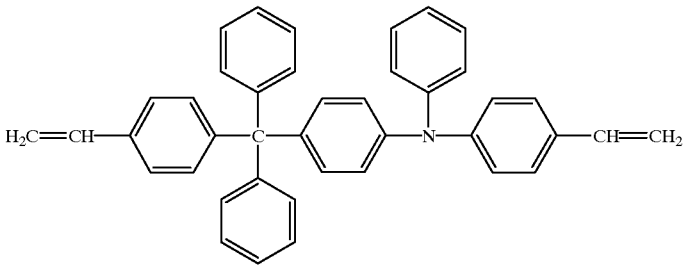 |
| 110 | 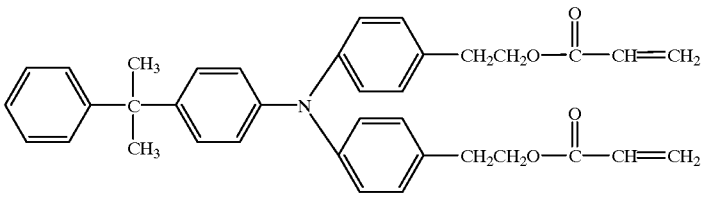 |

-continued
EXEMPLARY COMPOUND
| No. | COMPOUND |
|---|---|
| 111 | 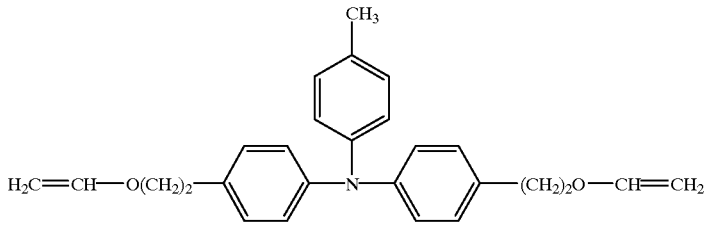 |
| 112 | 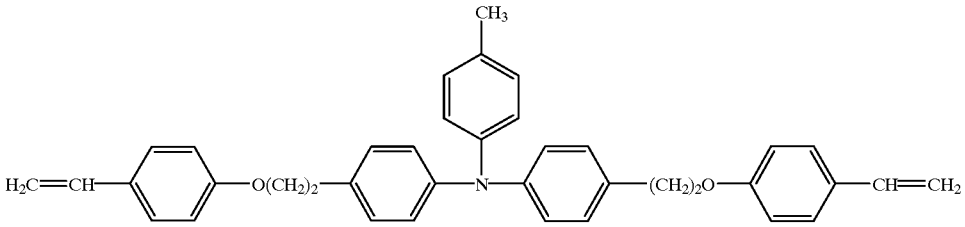 |
| 113 | 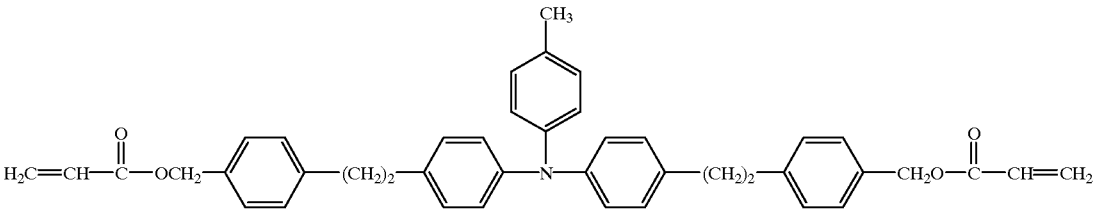 |
| 114 | 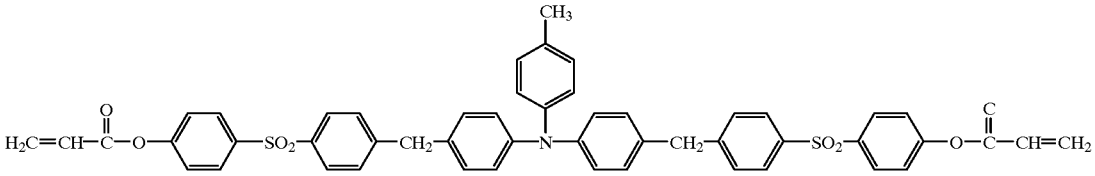 |
| 115 | 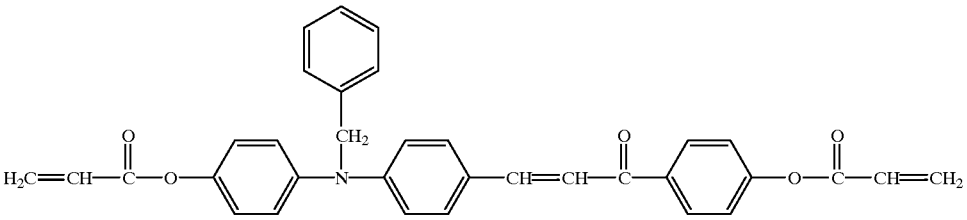 |
| 116 | 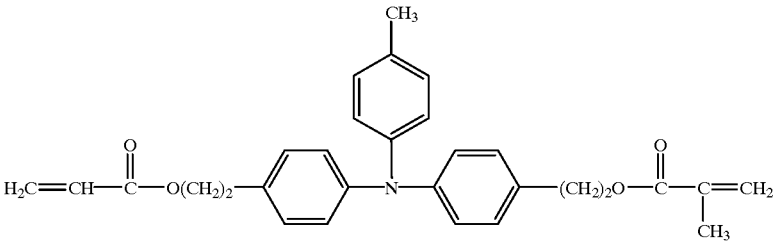 |

-continued
| No. | EXEMPLARY COMPOUND COMPOUND |
|---|---|
| 117 | 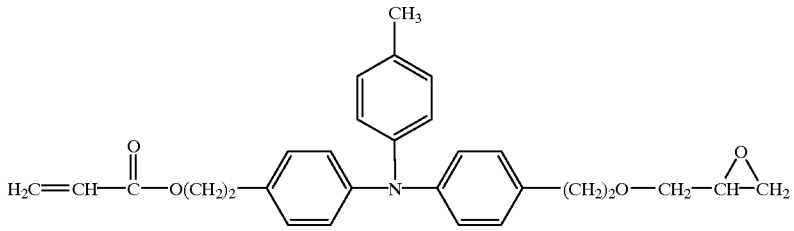 |
| 118 | 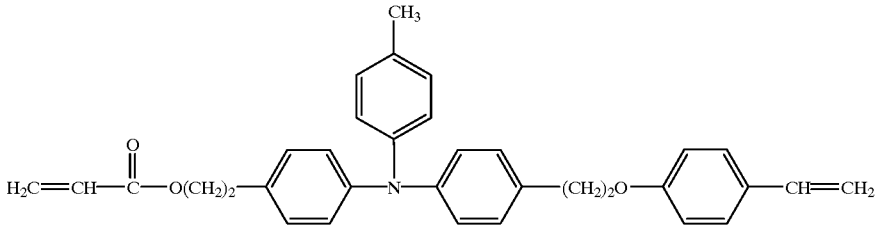 |
| 119 | 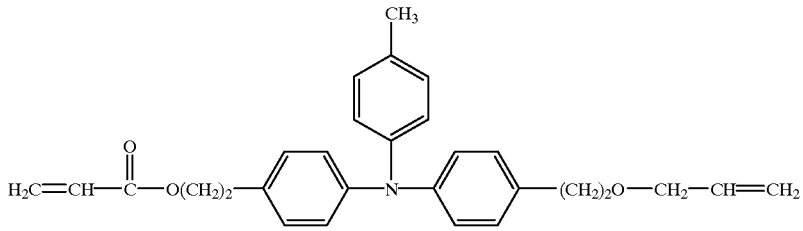 |
The representative synthesis examples of the hole-transporting compounds with chain-polymerizing functional groups, useful for the present invention, are described below.
Synthesis Example 1: Synthesis of Compound No. 6
The compound No. 6 was synthesized by the following route:
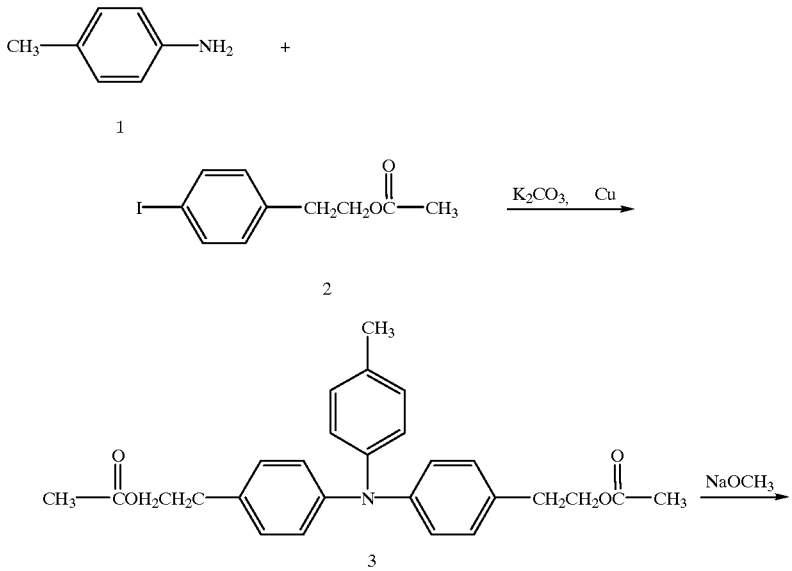

-continued

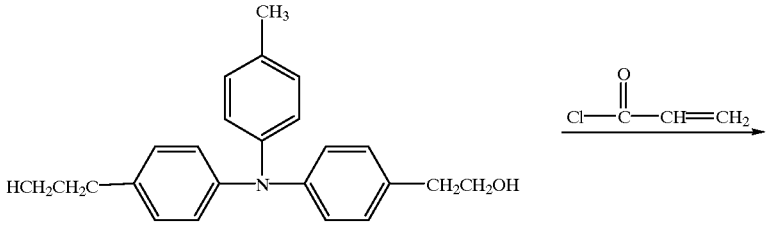

4

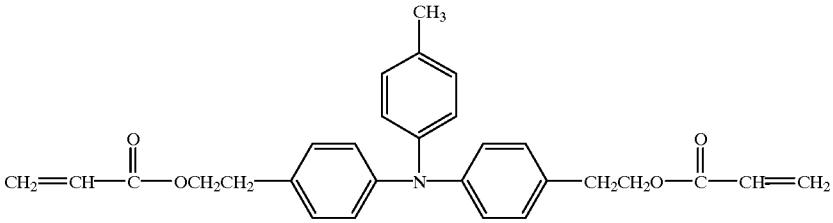

5

1 (50 g or 0.47 mol), 2 (406 g or 1.4 mol), anhydrous potassium carbonate (193 g) and powdered copper (445 g) were heated, together with 1,2-dichlorobenzene (1,200 g), at 180 to 190° C. for 15 hours with stirring. The effluent was filtered, and then treated under a vacuum to remove the solvent. The residue was column-purified with silica gel to form 132 g of 3.

3 (120 g or 0.28 mol) was added to 1,500 g of methylcellsolve, to which 150 g of sodium methylate was added slowly with stirring at room temperature. On completion of the addition, the effluent solution was stirred at room temperature for 1 hour, and then at 70 to 80° C. for 10 hours. It was then thrown into water, neutralized with dilute hydrochloric acid, extracted with ethyl acetate, and treated under a vacuum to remove the solvent, after the organic layer was dried by anhydrous sodium sulfate. The residue was column-purified with silica gel to form 78 g of 4.

4 (70 g or 0.2 mol) and triethylamine (40 g or 0.4 mol) were added to 400 mL of dried tetrahydrofuran (THF), cooled to 0 to 5° C., to which acryloyl chloride (55 g or 0.6 mol) was added slowly dropwise. On completion of the addition, the effluent was returned back slowly to room temperature, at which it was stirred for 4 hours. It was then thrown into water, neutralized, extracted with ethyl acetate, and treated to remove the solvent, after the organic layer was dried by anhydrous sodium sulfate. The residue was column-purified with silica gel to form 42 g of 5 (the compound No. 6) (oxidation potential: 0.83 V).

Synthesis Example 2: Synthesis of Compound No. 71

4 (10 g or 29 mmol), prepared by Synthesis Example 1, was added to 50 mL of dried THF, cooled to 0 to 5° C., to which 3.5 g of oily sodium hydride (approximately 60%) was added slowly. On completion of the addition, the effluent was returned back slowly to room temperature, at which it was stirred for 1 hour, and then cooled again to 0 to 5° C., to which allyl bromide (17.5 g or 145 mmol) was added slowly dropwise. On completion of the addition, the effluent solution was stirred at the same temperature for 1 hour, and returned back to room temperature, at which it was stirred additionally for 5 hours. It was then thrown into water, neutralized, extracted with toluene, and treated to remove the solvent, after the organic layer was dried by anhydrous sodium sulfate. The residue was column-purified with silica gel to form 5.6 g of the target compound (the compound No. 71) (oxidation potential: 0.81 V).

Synthesis Example 3: Synthesis of Compound No. 55

The compound No. 71 (3.0 g), prepared by Synthesis Example 2, was dissolved in 20 mL of dichloromethane, cooled to 0 to 5° C., to which 5.2 g of m-chloroperoxybenzoic acid (approximately 70%) was added slowly, stirred for 1 hour, and returned back to room temperature, at which it was stirred for 12 hours. The effluent solution was thrown into water, extracted with dichloromethane, and treated to remove the solvent, after the organic layer was dried by anhydrous sodium sulfate. The residue was column-purified with silica gel to form 2.1 g of the target compound (the compound No. 55) (oxidation potential: 0.81 V).

Synthesis Example 4: Synthesis of Compound No. 31

The compound No. 31 was synthesized by the following route:

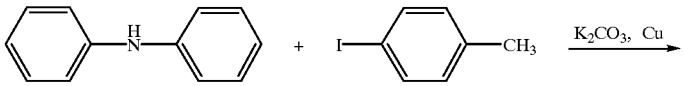

6 7

-continued

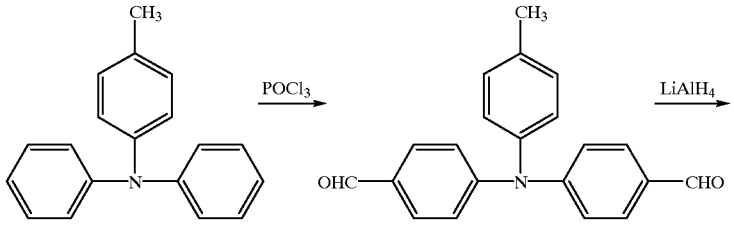

8 9

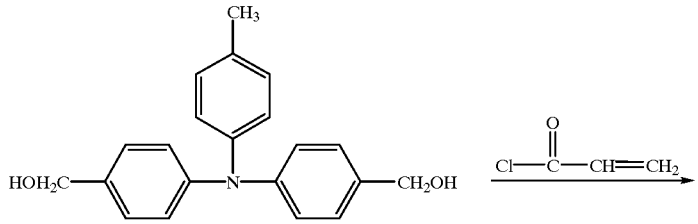

10

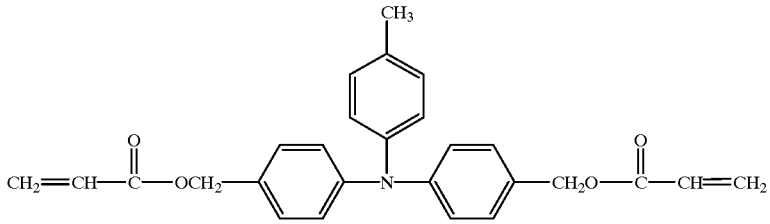

11

6 (40 g or 0.24 mol), 7 (77 g or 0. 35 mol), anhydrous potassium carbonate (48.8 g) and powdered copper (75 g) were heated, together with 1,2-dichlorobenzene (250 g), at 180 to 190° C. for 10 hours with stirring. The effluent was filtered, and then treated under a vacuum to remove the solvent. The residue was column-purified with silica gel to form 49 g of 8.

Dimethylformamide (DMF, 242.3 g) was cooled to 0 to 5° C., to which 84.8 g of phosphorus oxychloride was slowly added dropwise in such a way to keep the reaction system at 10° C. or less. On completion of the addition, the effluent solution was stirred at the same temperature for 15 min, to which a solution of 8 (24 g or 0.093 mol) and DMF (135 g) was slowly added dropwise. On completion of the addition, the effluent was stirred at the same temperature for 30 min, returned back to room temperature at which it was stirred for 2 hours, and heated to 80 to 85° C. at which it was stirred for 6 hours. It was then thrown into 2 kg of an aqueous solution of sodium acetate (approximately 15%), stirred for 12 hours, neutralized, and extracted with toluene. The organic layer was dried by anhydrous sodium sulfate to remove the solvent. The residue was column-purified with silica gel to form 16 g of 9.

Lithium aluminum hydride (1.85 g) was added to 100 mL of dried THF, to which a solution of 9 (15 g or 0.048 mol) and dried THF (100 mL) was slowly added, with stirring at room temperature. On completion of the addition, the effluent was stirred at room temperature for 4 hours, to which 400 mL of an aqueous solution of 5% hydrochloric acid was slowly added dropwise. On completion of the addition, the effluent was extracted with toluene, and the organic layer was dried by anhydrous sodium sulfate to remove the solution. The residue was column-purified with silica gel to form 13 g of 10.

10 (10 g or 0.03 mol) and triethylamine (12 g or 0.12 mol) were added to 150 mL of dried THF, cooled to 0 to 5° C., to which acryloyl chloride (8.5 g or 0.09 mol) was slowly added dropwise. On completion of the addition, the effluent was returned back slowly to room temperature, at which it was stirred for 4 hours. It was then thrown into water, neutralized, extracted with ethyl acetate, and treated to remove the solvent, after the organic layer was dried by anhydrous sodium sulfate. The residue was column-purified with silica gel to form 5.6 g of 11 (the compound No. 31) (oxidation potential: 0.93 V).

In the present invention, the hole-transporting compound is included in a three-dimensional, cross-linked structure at two or more cross-linked points via the covalent bonds in the photosensitive layer by polymerizing/cross-linking the hole-transporting compound with at least two chain-polymerizing functional groups in the same molecule. It is possible to polymerize/cross-link the hole-transporting compound by itself, or after mixing it with another compound with chain-polymerizing group, its type and quantity being not limited. The other compound above with chain-polymerizing group may be a monomer, oligomer or polymer with chain-polymerizing group.

When the functional group in the hole-transporting compound is the same as, or polymerizable with, that in the other chain-polymerizing compound, they can be bonded to each other via a covalent bond, to form a three-dimensional, cross-linked, copolymerized structure. When these functional groups are not polymerizable with each other, the photosensitive layer is composed of a mixture of two or more three-dimensional hardened compounds, or of the three-dimensional, hardened compound as the major ingredient which contains the other chain-polymerizing compound monomer or hardened compound thereof. In such a case, it is possible to form an inter penetrating network (IPN) by carefully controlling its compounding ratio and film-making process.

The photosensitive layer may be made of a monomer, oligomer or polymer which has no group chain-polymerizable with the hole-transporting compound, or of a monomer, oligomer or polymer which has a polymerizable group other than chain-polymerizable one. It is also possible, depending on situations, for the photosensitive layer to contain a hole-transporting compound which is not chemically included into the three-dimensional, cross-linked structure, i.e., a compound having no chain-polymerizing functional group. Moreover, it may be incorporated with other types of additives, e.g., lubricant of finely powdered resin containing fluorine.

The photosensitive member of the present invention has a photosensitive layer comprising a charge-generating layer containing a charge-generating compound and charge-transporting layer containing a charge-transporting compound, formed one on another on a support in this or reversed order. The photosensitive layer may be of a single layer with a charge-generating and charge-transporting compound dispersed therein. In the former laminated type photosensitive layer, two or more charge-transporting layers may be used. In the latter, single-layer photosensitive layer, the layer containing a charge-generating and charge-transporting compound may be further laminated with a charge-transporting layer or protective layer.

Any configuration can be used, so long as the hole-transporting compound with chain-polymerizing groups and/or that compound after being polymerized/cross-linked are included in the photosensitive layer. However, the function-separated type photosensitive member configuration, with a charge-generating and charge-transporting layer laminated in this order on a support, is preferable viewed from characteristics of the member, in particular electric characteristics (e.g., residual potential) and durability. One of the advantages brought by the present invention is durability of the surface layer improved without sacrificing charge-transporting capacity.

Any material may be used for the support for the electrophotographic photosensitive member of the present invention, so long as it is electroconductive. It may be of a metal, e.g., aluminum, copper, chromium, nickel, zinc or stainless steel, or an alloy, formed into a drum or sheet. It may be also of a plastic film laminated with metallic foil (e.g., aluminum or copper foil) or deposited with aluminum, indium oxide, tin oxide or the like, or metallic film, plastic film or paper provided with an electroconductive layer formed by spreading an electroconductive material by itself or combined with a binder resin.

The present invention may have a subbing layer with barrier and adhesion functions between the support and photosensitive layer. The subbing layer is provided for, e.g., improvement of the photosensitive layer in adhesion or paintability, protection of the support, coating defects in the support, improvement in characteristics of injecting charge from the support, or protection of the photosensitive layer from electrical breakdown.

The materials suitable for the subbing layer include polyvinyl alcohol, poly-N-vinyl imidazole, polyethylene oxide, ethyl cellulose, ethylene-acrylate copolymer, casein, polyamide, N-methoxy-methylated 6-nylon, copolymerized nylon, glue, and gelatin. For forming the subbing layer, a suitable material dissolved in an adequate solvent is spread over the support and dried. Its thickness is preferably 0.1 to 2 $\mu$m.

The laminated type photosensitive layer has a charge-generating and charge-transporting layer.

The materials suitable for the charge-generating layer include dyes based on selenium-tellurium, pyrilium and thiapyrilium, and a variety of central metals and crystalline systems. More concretely, they include crystalline phthalocyanine compounds of $\alpha$, $\beta$, $\gamma$, $\epsilon$, or X type; pigments of anthoanthorone, dibenzpyrenequinone, pyranthrone, trisazo, dis-azo, monoazo, indigo, quinacridon, asymmetric quinocyanine; quinocyanine; and amorphous silicon (disclosed by Japanese Patent Application Laid-Open No. 54-143645).

The charge-generating layer is formed by the following procedure: a mixture of the charge-generating material and a 0.3 to 4 times larger quantity of a binder resin is dispersed in a solvent thoroughly by a homogenizer, supersonic disperser, ball mill, vibration ball mill, sand mill, attriter, roll mill or the like, and spread and dried. It is a film of single composition of the charge-generating material, deposited by, e.g., evaporation. Its thickness is preferably 5 $\mu$m or less, more preferably 0.1 to 2 $\mu$m.

The binder resins useful for the present invention include polymers/copolymers of vinyl compounds, e.g., styrene, vinyl acetate, vinyl chloride, acrylate ester, methacrylate ester, vinylidene fluoride, trifluoroethylene; and polyvinyl alcohol, polyvinyl acetal, polycarbonate, polyester, polysulfone, polyphenylene oxide, polyurethane, cellulosic resin, phenolic resin, melamine resin, silicon-containing resin and epoxy resin.

The hole-transporting compound with chain-polymerizing functional groups, useful for the present invention, can be used for forming the charge-transporting layer on the charge-generating layer, or the surface protective layer having hole-transporting capacity on the charge-transporting layer of the charge-transporting material and binder resin on the charge-generating layer. The protective layer, having hole-transporting capacity, is within the definition of photosensitive layer.

In each case, it is preferable that a solution containing the hole-transporting compound is spread and then polymerized/cross-linked. It is also possible to form the protective layer using a solution containing the hole-transporting compound, reaction-hardened and then dispersed or dissolved again in a solvent.

The hole-transporting compound with chain-polymerizing groups for the charge-transporting layer is used at 20 wt. % or more as the hydride adduct of the hole-transporting group (e.g., A in the general formula (1)) based on the whole charge-transporting layer after it is hardened, preferably 40 wt. % or more. At below 20 wt. %, its charge-transporting capacity tends to decrease, possibly causing problems, e.g., decreased sensitivity and increased residual potential. Thickness of the charge-transporting layer is preferably 1 to 50 $\mu$m, more preferably 3 to 30 $\mu$m.

When the hole-transporting compound with chain-polymerizing groups is used for forming the surface protective layer on the charge-generating/charge-transporting layers, the charge-transporting layer below the protective layer can be formed by coating and drying a solution of an adequate charge-transporting compound and binder resin (which can be selected from the above resins for the charge-generating layer) dispersed/dissolved in a solvent. The adequate charge-transporting compounds include polymers having heterocyclic or condensed polycyclic aromatic compounds, e.g., poly-N-vinylcarbazole and polystyryl anthracene; heterocyclic compounds, e.g., pyrazoline, imidazole, oxazole, triazole and carbazole; triaryl alkane derivatives, e.g., triphenylmethane; triarylamine derivatives, e.g., triphenylamine; and low-molecular-weight compounds, e.g., phenylenediamine derivatives, N-phenylcarbazole derivatives, stilbene derivatives and hydrazine derivatives.

For the ratio of the charge-transporting compound to binder resin, in the case when all weight of both the charge-transporting compound and the binder resin is made 100% by weight, the charge-transporting compound accounts for preferably 30 to 100% by weight based on 100% of the total composition of the charge-transporting compound and binder resin, more preferably 50 to 100% by weight at below 30% by weight of the charge-transporting compound, charge-transporting capacity may decrease, possibly causing problems such as decreased sensitivity and increased residual potential. Thickness of the charge-transporting layer is preferably 1 to 50 $\mu$m as total thickness of the upper surface-protective layer and charge-transporting layer, more preferably 5 to 30 $\mu$m.

In any case of the present invention, the photosensitive layer containing the hardened hole-transporting compound with chain-polymerizing groups may be incorporated with the charge-transporting compound.

When the single-layered photosensitive layer is used for the present invention, the photosensitive layer may be formed by polymerizing/cross-linking a solution containing both hole-transporting and charge-generating compounds, or the single-layered photosensitive layer containing both hole-transporting and charge-generating compounds may be coated with a solution containing the hole-transporting compound to be polymerized/cross-linked thereon.

The photosensitive layer for the present invention may be incorporated with various additives, including an inhibitor (e.g., antioxidant agent or ultraviolet ray absorber), or a lubricant (e.g., finely powdered resin containing fluorine).

The methods for spreading a solution to form each layer include dip coating, spray coating, curtain coating and spin coating. Of these, dip coating is more preferable than the others, because of its high efficiency/productivity. The known film-making processes, e.g., evaporation and plasma-aided one, may be adequately selected for the present invention.

The hole-transporting compound with chain-polymerizing groups, useful for the present invention, may be polymerized/cross-linked by the aid of radioactive ray, heat or light.

The one aided by radioactive ray is more preferable, because it can dispense with a polymerization initiator, which is one of the most notable advantages of this process. This will make it possible to form a three-dimensional photosensitive matrix of very high purity, and secure good electrophotographic characteristics. Its productivity is also high, because polymerization is effected more efficiently in a shorter time. Another advantage comes from high permeability of radioactive ray, which hardens the layer while being much less affected by a shielding material, e.g., an additive or the like, present in the layer or forming a thick layer.

It should be noted, however, that the polymerization may be retarded, depending on type of the chain-polymerizing group used or type of its central skeleton. In such a case, a polymerization initiator may be used in an acceptable range.

The radioactive rays useful for the present invention include electron ray and gamma ray, the former being more preferable for its capacity to enhance polymerization efficiency. Suitable accelerators for electron ray, when it is used, include scanning, electrocurtain, broad beam, pulse and laminar types. It is very important to set adequate irradiation conditions, when electron ray is used, for the photosensitive layer to manifest the electrical characteristics and durability. The hole-transporting compound is irradiated with electron ray, accelerated preferably at 300 KV or less, more preferably 150 KV or less, at an irradiation dose preferably in a range from 1 to 100 Mrad, more preferably from 3 to 50 Mrad. Deterioration of the photosensitive characteristics increases as acceleration voltage of the electron ray increases beyond 300 KV. For irradiation dose, cross-linking will be insufficient at below 1 Mrad, and the photosensitive characteristics tend to be deteriorated at above 100 Mrad.

When heat-aided polymerization is adopted, it may be effected in the presence or absence of a polymerization initiator, the former being more preferable for efficient polymerization process at a lower temperature.

Any polymerization initiator may be used, so long as it has a half-life at room temperature or above. The initiators useful for the present invention include ammonium persulfate; peroxides, e.g., dicumyl peroxide, benzoyl peroxide, cyclohexane peroxide, t-butyl hydroperoxide and di-t-butyl peroxide; and azo compounds, e.g., azo-bis-butylonitrile. It is dosed at around 0.01 to 10 parts by weight per 100 parts by weight of the compound having chain-polymerizing groups. Reaction temperature varies in a range from room temperature to 200° C., depending on the initiator used.

When light-aided polymerization is used for the present invention, a photopolymerization initiator is normally needed, because the reaction very rarely proceeds by light energy only.

The photopolymerization initiator initiates the polymerization, after absorbing ultraviolet ray having a wavelength of 400 nm or less to generate the active species, e.g., radicals and ions. The initiators useful for the present invention include those generate radicals, e.g., acetophenone-, benzoin-, benzophenone- and thioxanthone-based ones; and those generate ions, e.g., diazonium, sulfonium, iodonium and metal complex compounds. More recently, however, new polymerization initiators have been proposed as the ones which generate the above active species by absorbing infrared/visible rays having a wavelength of above 400 nm. They can be also used for the present invention. The light-aided initiator is dosed at around 0.01 to 50 parts by weight per 100 parts by weight of the compound having chain-polymerizing groups. A heat-aided and light-aided initiator can be used simultaneously for the present invention.

FIGURE illustrates the electrophotographic apparatus equipped with the process cartridge having the electrophotographic photosensitive member of the present invention. The drum-shaped electrophotographic photosensitive member 1 of the present invention is driven to rotate around the axis 2 at a given circumferential speed in the arrowed direction. The member 1 is uniformly electrified positively or negatively at a given potential by the primary electrifying means 3, while being rotated, and then exposed to light 4 by an exposure means, e.g., slit or laser beam scanning (not shown). As a result, electrostatic latent images are formed one by one over the photosensitive member 1.

The electrostatic latent image formed is then developed with a toner by the developing means 5, and the developed image is transferred one after another by the transferring means 6 to the transfer paper 7, which is supplied synchronously with rotation of the photosensitive member 1 from a paper feeder (not shown) to the space between the photosensitive member 1 and transferring means 6. The transfer paper 7, on receiving the developed image, is separated from the photosensitive member 1 and sent to the image fixing means 8, where the image is fixed. The fixed image is printed out as a copy by a printer outside of this electrophotographic apparatus.

The surface of the photosensitive member 1 is cleaned by the cleaning means 9 to remove the residual toner, after the image is transferred, and treated by front exposure light 10 emitted from an exposure means (not shown) to remove electricity, for repeated use for forming images. When the primary electrifying means 3 is a contact type equipped with an electrifying roll or the like, front exposure light may be dispensed with.

In the present invention, some of the constitutional members, e.g., the electrophotographic photosensitive member 1, primary electrifying means 3, developing means 5 and cleaning means 9, can be integrated into a process cartridge assembly, which is freely attached to or detached from an electrophotographic apparatus body, e.g., a copier or laser beam printer. For example, at least one of the primary electrifying means 3, developing means 5 and cleaning means 9 is supported together with the photosensitive member 1 to form a cartridge assembly, e.g., the process cartridge 11 attachable to or detachable from the apparatus body using a guiding means, e.g., rail 12 in the apparatus body.

The exposure light 4 is the light reflected from or passing through an original image, or the laser beam scanned in accordance with a signal of the original image read by a sensor and signalized, or the light irradiated by driving an LED array or liquid-crystalline shutter array.

The electrophotographic photosensitive member of the present invention can be widely used in electrophotographic application devices, e.g., laser beam printers, CRT printers, LED printers, liquid-crystalline printers and laser-aided printers, not limited to electrophotographic copiers.

The present invention is described by Examples, where "part(s)" means part(s) by weight.

EXAMPLE 1

The coating material for the electroconductive layer was prepared by the following procedure. A mixture of 50 parts of electroconductive titanium oxide particles coated with tin oxide containing antimony oxide at 10%, 25 parts of phenolic resin, 20 parts of methylcellsolve, 5 parts of methanol and 0.002 parts of silicone oil (polydimethyl siloxane/polyoxyalkylene copolymer having an average molecular weight of 3,000) was prepared by dispersing these components by a sand mill with glass beads (diameter: 1 mm) for 2 h. This coating material was spread by dip coating over an aluminum cylinder (diameter: 30 mm) and dried at 140° C. for 30 min, to form a 20 $\mu$m thick electroconductive layer on the cylinder.

The coating material for the intermediate layer was prepared by dissolving 5 parts of N-methoxymethylated nylon in 95 parts of methanol. This coating material was spread by dip coating over the above electroconductive layer and dried at 100° C. for 20 min, to form a 0.6 $\mu$m thick intermediate layer thereon.

A mixture of 5 parts of a bis-azo pigment shown by the following structural formula A, 2 parts of polyvinyl butylal resin and 60 parts of cyclohexanone was prepared by dispersing these components by a sand mill with glass beads (diameter: 1 mm) for 24 h, to which 60 parts of tetrahydrofuran was added to prepare the coating material for the charge-generating layer. This coating material was spread by dip coating over the intermediate layer and dried at 100° C. for 15 min, to form a 0.2 $\mu$m thick charge-generating layer.

(A)

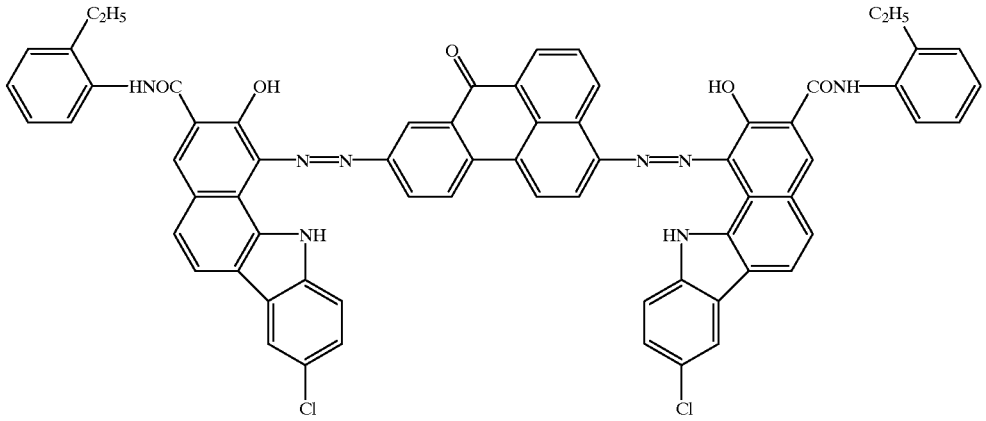

The compound No. 6 as the hole-transporting compound (60 parts) was dissolved in a mixed solvent of monochlorobenzene (30 parts) and dichloromethane (30 parts), to prepare the coating material for the charge-transporting layer. This coating material was spread over the charge-generating layer, and irradiated with electron ray under the conditions of accelerating voltage: 150 KV and irradiation dose: 30 Mrad, and hardened to form a 15 $\mu$m thick charge-transporting layer, completing the electrophotographic photosensitive member.

The electrophotographic photosensitive member thus prepared was assessed for its temporal separation, electrophotographic characteristics and durability. The temporal separation was assessed by an acceleration test in which the sample was preserved at 75° C. for 14 days with a cleaning blade of urethane rubber for copiers pressed to the sample surface. It was then microscopically observed to judge whether there was a separation or not. When there was no separation observed, the test was further continued for a total of 30 days.

The electrophotographic characteristics and durability were assessed by setting up the sample in a copier (Canon Inc., LBP-SX). The initial photosensitive member characteristics [potential at the dark section Vd, light decay sensitivity (quantity of light necessary to decay potential at the dark section set at −700 V to −150 V), and residual potential Vsl (potential when the sample was irradiated with light 3 times as large a quantity as that for light decay sensitivity)] were measured. The durability test in which an original image was copied 10,000 times was conducted, to observe whether there was a defective copy or not visually, wear of the photosensitive member, and the photosensitive member characteristics, and to determine changes in the characteristics, ΔVd, ΔVl (difference between quantity of light necessary to set the initial Vl at −150 V and Vl of the durability-tested sample irradiated with the same quantity of light) and ΔVsl.

The results are given in Table 1. The photosensitive member showed very stable and good characteristics: no separation was observed on the tested photosensitive member, its photosensitive characteristics were good, only a limited extent of wear was observed, and photosensitive characteristics changed little by the durability test.

EXAMPLES 2 to 25

The same procedure as used for Example 1 was repeated for each of Examples 2 to 25, except that the compound No. 6 as the hole-transporting compound was replaced by the one shown in the following Table, to prepare and assess the electrophotographic photosensitive members. The results are given in Table 1.

| Example | Hole-transporting Compound No. | Example | Hole-transporting Compound No. |
|---|---|---|---|
| 2 | 27 | 14 | 25 |
| 3 | 29 | 15 | 101 |
| 4 | 31 | 16 | 114 |
| 5 | 32 | 17 | 55 |
| 6 | 113 | 18 | 56 |
| 7 | 11 | 19 | 112 |
| 8 | 13 | 20 | 111 |
| 9 | 7 | 21 | 71 |
| 10 | 4 | 22 | 116 |
| 11 | 5 | 23 | 117 |
| 12 | 23 | 24 | 118 |
| 13 | 24 | 25 | 119 |

EXAMPLE 26

The same procedure as used for Example 1 was repeated, except that 48 parts of the compound No. 6 as the hole-transporting compound was used and 12 parts of an acrylic monomer shown by the structural formula (B) was added, to prepare and assess the electrophotographic photosensitive member. The results are given in Table 1.

(B)

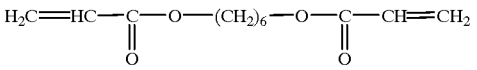

EXAMPLE 27

The same procedure as used for Example 7 was repeated, except that 48 parts of the compound No. 11 as the hole-transporting compound was used and 12 parts of an acrylic monomer shown by the structural formula (C) was added, to prepare and assess the electrophotographic photosensitive member. The results are given in Table 1.

(C)

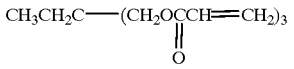

EXAMPLE 28

The same procedure as used for Example 1 was repeated, except that 48 parts of the compound No. 6 as the hole-transporting compound was used and 12 parts of the acrylic oligomer (number-average molecular weight: 2,000) shown by the structural formula (D) was added, to prepare and assess the electrophotographic photosensitive member. The results are given in Table 1.

(D)

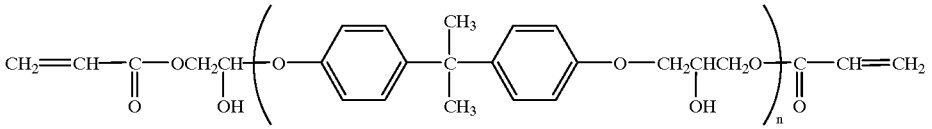

EXAMPLES 29 to 33

The same procedure as used for Example 1 was repeated for each of Examples 29 to 33, except that each photosensitive member was irradiated with electron ray under the conditions shown in the following Table. Each of them showed good resistance to wear and gave good copies during the durability test, although a slightly decreased sensitivity and increased residual potential were observed in the initial electrophotographic characteristics, on account of increased ray dose. The results are given in Tables 1 and 2.

| Example | Irradiation condition (accelerqation volt/ray dose) |
|---|---|
| 29 | 200 Kv/30 Mrad |
| 30 | 300/30 |
| 31 | 150/80 |
| 32 | 150/150 |
| 33 | 150/200 |

EXAMPLE 34

The same procedure as used for Example 1 was repeated to form the charge-generation layer.

A styryl compound shown by the structural formula (E) (20 parts):

(E)

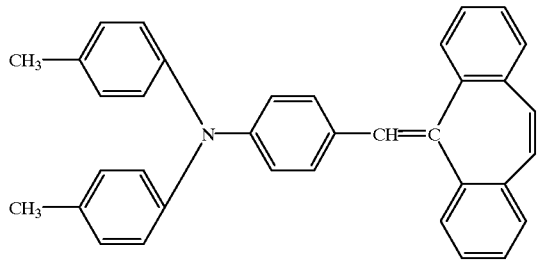

and 10 parts of polycarbonate resin (number-average molecular weight: 20,000) having a repeating unit shown by the structural formula (F):

(F)

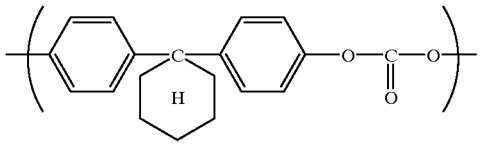

were dissolved in a mixed solvent of monochlorobenzene (50 parts) and dichloromethane (20 parts), to prepare the coating material for the charge-transporting layer. This coating material was spread over the charge-generating layer, to form the 10 $\mu$m thick charge-transporting layer.

The compound No. 6 as the hole-transporting compound (60 parts) was dissolved in a mixed solvent of monochlorobenzene (50 parts) and dichloromethane (50 parts), to prepare the coating material for the surface protective layer. This coating material was spread over the charge-transporting layer by spray coating, and irradiated with electron ray under the conditions of accelerating voltage: 150 KV and irradiation dose: 30 Mrad, and hardened to form a 5 $\mu$m thick surface protective layer, completing the electrophotographic photosensitive member. The same procedure as used for Example 1 was used to assess the electrophotographic photosensitive member. The results are given in Table 2.

EXAMPLE 35

The same procedure as used for Example 34 was repeated, except that the compound No. 6 as the hole-transporting compound was replaced by the compound No. 7 as the hole-transporting compound, to prepare and assess the electrophotographic photosensitive member. The results are given in Table 2.

EXAMPLE 36

The same procedure as used for Example 34 was repeated, except that 30 parts of the compound No. 6 as the hole-transporting compound was used and 30 parts of the acrylic monomer shown by the structural formula (B), used for Example 26, was added, to prepare and assess the electrophotographic photosensitive member. The results are given in Table 2.

EXAMPLE 37

The same procedure as used for Example 34 was repeated, except that 30 parts of the compound No. 6 as the hole-transporting compound was used and 30 parts of the acrylic oligomer shown by the structural formula (D), used for Example 28, was added, to prepare and assess the electrophotographic photosensitive member. The results are given in Table 2.

EXAMPLE 38

The same procedure as used for Example 1 was repeated to form the charge-generation layer. The compound No. 6 as the hole-transporting compound (60 parts) and 0.6 parts of a photopolymerization initiator shown by the structural formula (J)

(J)

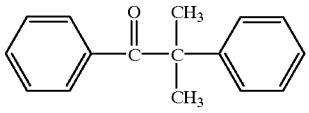

were dissolved in a mixed solvent of monochlorobenzene (30 parts) and dichloromethane (30 parts), to prepare the coating material for the charge-transporting layer. This coating material was spread over the charge-generating layer, and irradiated with light emitted from a metal halide lamp at an intensity of 500 mW/cm$^2$ for 30 sec, and hardened to form a 15 $\mu$m thick charge-transporting layer, completing the electrophotographic photosensitive member. The same procedure as used for Example 1 was used to assess the electrophotographic photosensitive member.

The results are given in Table 3. The photosensitive member showed very stable and good characteristics: no separation was observed on the tested photosensitive member, its photosensitive characteristics were good, only a limited extent of wear was observed, and photosensitive characteristics changed little by the durability test.

EXAMPLES 39 to 48

The same procedure as used for Example 38 was repeated for each of Examples 39 to 48, except that the compound No. 6 as the hole-transporting compound was replaced by the one shown in the following table, to prepare and assess the electrophotographic photosensitive members. The results are given in Table 2.

EXAMPLES 49 to 51

The same procedure as used for Example 38 was repeated for each of Examples 49 to 51, except that the compound No. 6 as the hole-transporting compound was replaced by the one shown by the following table and the photopolymerization initiator shown by the structural formula (J) was replaced by a photopolymerization initiator shown by the structural formula (K), (K)

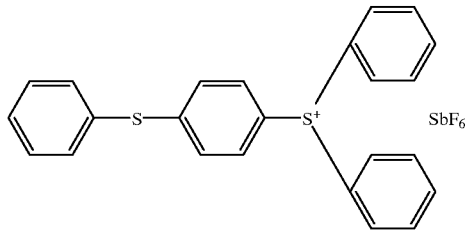

to prepare and assess the electrophotographic photosensitive members. The results are given in Table 2.

| Example | Hole-transporting Compound No. | Example | Hole-transporting Compound No. |
|---|---|---|---|
| 39 | 31 | 45 | 5 |
| 40 | 113 | 46 | 101 |
| 41 | 11 | 47 | 114 |
| 42 | 13 | 48 | 116 |
| 43 | 7 | 49 | 55 |
| 44 | 4 | 50 | 56 |
| | | 51 | 111 |

EXAMPLE 52

The same procedure as used for Example 38 was repeated, except that the compound No. 6 as the hole-transporting compound was replaced by the compound No. 117, and 0.3 parts of the photopolymerization initiator (J) and 0.3 parts of the photopolymerization initiator (K) were added, to prepare and assess the electrophotographic photosensitive member. The results are given in Table 2.

EXAMPLE 53

The same procedure as used for Example 38 was repeated, except that the photopolymerization initiator (J) was replaced by a thermal polymerization initiator shown by the structural formula (L):

(L)

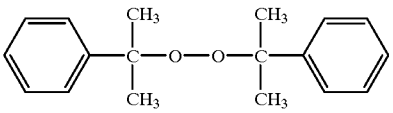

and hardening by the aid of ultraviolet ray was replaced by hardening under heating at 140° C. for 1 h, to prepare and assess the electrophotographic photosensitive member. The results are given in Table 2.

EXAMPLE 54

The same procedure as used for Example 53 was repeated, except that the compound No. 6 as the hole-transporting compound was replaced by the compound No. 71, to prepare and assess the electrophotographic photosensitive member. The results are given in Table 2.

EXAMPLE 55

The same procedure as used for Example 53 was repeated, except that the compound No. 6 as the hole-transporting compound was replaced by the compound No. 112, to prepare and assess the electrophotographic photosensitive member. The results are given in Table 2.

EXAMPLE 56

The same procedure as used for Example 38 was repeated, except that 48 parts of the compound No. 6 as the hole-transporting compound was used and 12 parts of the acrylic monomer shown by the structural formula (B) was added, to prepare and assess the electrophotographic photosensitive member. The results are given in Table 2.

EXAMPLE 57

The same procedure as used for Example 49 was repeated, except that 48 parts of the compound No. 55 as the hole-transporting compound was used and 12 parts of an epoxy monomer shown by the structural formula (M)

(M)

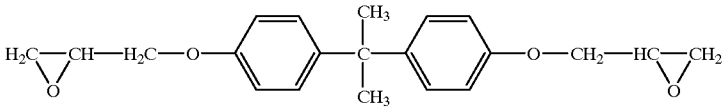

was added, to prepare and assess the electrophotographic photosensitive member. The results are given in Table 2.

EXAMPLE 58

The same procedure as used for Example 38 was repeated, except that 48 parts of the compound No. 6 as the hole-transporting compound was used and 12 parts of the acrylic oligomer (number-average molecular weight: 2,000) shown by the structural formula (D) was added, to prepare and assess the electrophotographic photosensitive member. The results are given in Table 2.

EXAMPLE 59

The same procedure as used for Example 53 was repeated, except that 48 parts of the compound No. 6 as the hole-transporting compound was used and 12 parts of the acrylic monomer shown by the structural formula (B) was added, to prepare and assess the electrophotographic photosensitive member. The results are given in Table 2.

EXAMPLE 60

The same procedure as used for Example 34 was repeated to form the charge-transporting layer.

The compound No. 6 as the hole-transporting compound (60 parts) and 0.6 parts of a photopolymerization initiator shown by the structural formula (J) were dissolved in a mixed solvent of monochlorobenzene (50 parts) and dichloromethane (50 parts), to prepare the coating material for the surface protective layer.

This coating material was spread over the charge-transporting layer by spray coating, and irradiated with light emitted from a metal halide lamp at an intensity of 500 mW/cm$^2$ for 30 sec, and hardened to form a 5 $\mu$m thick surface of protective layer, completing the electrophotographic photosensitive member. The same procedure as used for Example 38 was used to assess the electrophotographic photosensitive member. The results are given in Table 2.

EXAMPLE 61

The same procedure as used for Example 60 was repeated, except that the compound No. 6 as the hole-transporting compound was replaced by the compound No. 55 as the hole-transporting compound, and the photopolymerization initiator shown by the structural formula (J) was replaced by the photopolymerization initiator shown by the structural formula (K), to prepare and assess the electrophotographic photosensitive member. The results are given in Table 2.

EXAMPLE 62

The same procedure as used for Example 60 was repeated, except that 30 parts of the compound No. 6 as the hole-transporting compound was used and 30 parts of the acrylic monomer shown by the structural formula (B) was added, to prepare and assess the electrophotographic photosensitive member. The results are given in Table 2.

EXAMPLE 63

The same procedure as used for Example 61 was repeated, except that 30 parts of the compound No. 55 as the hole-transporting compound was used and 30 parts of the epoxy monomer shown by the structural formula (M) was added, to prepare and assess the electrophotographic photosensitive member. The results are given in Table 2.

EXAMPLE 64

The same procedure as used for Example 62 was repeated, except that the acrylic monomer shown by the structural formula (B) was replaced by the acrylic oligomer (number-average molecular weight: 2,000) shown by the structural formula (D), to prepare and assess the electrophotographic photosensitive member. The results are given in Table 2.

Comparative Example 1

The same procedure as used for Example 1 was repeated to form the charge-generation layer.

The styryl compound shown by the structural formula (E) (15 parts) and 15 parts of polymethyl methacrylate resin (number-average molecular weight: 40,000) having a repeating unit shown by the structural formula (G)

(G)

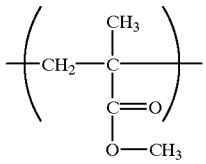

were dissolved in a mixed solvent of monochlorobenzene (50 parts) and dichloromethane (20 parts), to prepare the coating material for the charge-transporting layer. This coating material was spread over the charge-generating layer, to form the 15 $\mu$m thick of charge-transporting layer, completing the electrophotographic photosensitive member.

The same procedure as used for Example 1 was used to assess the electrophotographic photosensitive member. A separation was observed in 14 days. Although it showed good initial electrophotographic characteristics, but was worn more in the surface layer, when durability-tested, showing defective images, e.g., fogging and scratches. The charge-transporting layer was worn to lose its thickness, after 8,000 copies were produced, causing failure of electrification and no longer possible to produce the copies. The results are given in Table 3.

Comparative Example 2

The same procedure as used for Comparative Example 1 was repeated, except that the polymethyl methacrylate resin shown by the structural formula (G) was replaced by the polycarbonate resin (number-average molecular weight: 20,000) shown by the structural formula (F), to form and assess the electrophotographic photosensitive member.

A separation was observed in 30 days. The electrophotographic photosensitive member showed slightly better durability than the one prepared by Comparative Example 1, but still insufficient to produce defective images, when durability-tested. The results are given in Table 3.

Comparative Example 3

The same procedure as used for Comparative Example 2 was repeated, except that 10 parts of the styryl compound shown by the structural formula (E) and 15 parts of the polycarbonate resin shown by the structural formula (F) were used, to form and assess the electrophotographic photosensitive member. The electrophotographic photosensitive member showed better durability than the one prepared by Comparative Example 2, but decreased in charge-transporting capacity because of long distance between the charge-transporting materials, decreasing sensitivity and increasing residual potential. As a result, it produced ghost images. The results are given in Table 3.

Comparative Example 4

The same procedure as used for Example 34 was repeated to form the charge-transporting layer.

Then, 10 parts of the styryl compound shown by the structural formula (E) and 15 parts of the polycarbonate resin shown by the structural formula (F) were dissolved in a mixed solvent of monochlorobenzene (50 parts) and dichloromethane (30 parts), to prepare the coating material for the surface protective layer. This coating material was spread over the charge-transporting layer by spray coating, and dried at 120° C. for 1 h, to form the 5 $\mu$m thick surface protective layer, completing the electrophotographic photosensitive member.

The same procedure as used for Example 34 was used to assess the electrophotographic photosensitive member. It showed neither decrease in sensitivity nor increase in residual potential, because of the presence of the charge-transporting layer of high charge-transporting capacity under the surface protective layer, and produced no ghost images. Nevertheless, however, it was still insufficient in durability, because the images produced during the durability test still suffered scratches and fogging. The results are given in Table 3.

Comparative Example 5

The same procedure as used for Example 1 was repeated, except that the compound No. 6 as the hole-transporting compound was replaced by the compound shown by the structural formula (H), disclosed by Japanese Patent Application Laid-Open No. 5-216249, to form and assess the electrophotographic photosensitive member. The electrophotographic photosensitive member showed good initial electrophotographic characteristics, but was much less durable than the one prepared by Example 1. The results are given in Table 3.

(H)

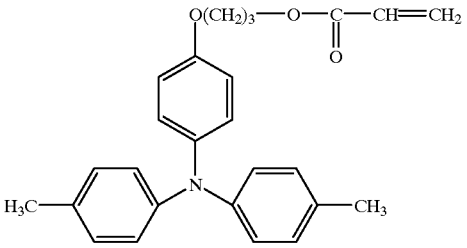

Comparative Example 6

The same procedure as used for Example 26 was repeated, except that the compound No. 6 as the hole-transporting compound was replaced by the compound shown by the structural formula (H), to form and assess the electrophotographic photosensitive member. The electrophotographic photosensitive member showed good initial electrophotographic characteristics, but was much less durable than the one prepared by Example 26. The results are given in Table 3.

Comparative Example 7

The same procedure as used for Example 1 was repeated to form the charge-generation layer.

Then, 20 parts of polycarbonate resin (number-average molecular weight: 20,000) shown by the structural formula (I), synthesized by the method disclosed by Japanese Patent Application Laid-Open No. 8-248649 (P.10 to 11) was dissolved in 80 parts of tetrahydrofuran, to prepare the coating material for the charge-transporting layer. This coating material was spread over the charge-generating layer, to form the 15 $\mu$m thick of charge-transporting layer, completing the electrophotographic photosensitive member. The same procedure as used for Example 1 was used to assess the electrophotographic photosensitive member. It showed higher mechanical strength than those prepared by Comparative Examples 1 and 2, but was still insufficient in durability. The results are given in Table 3.

(I)

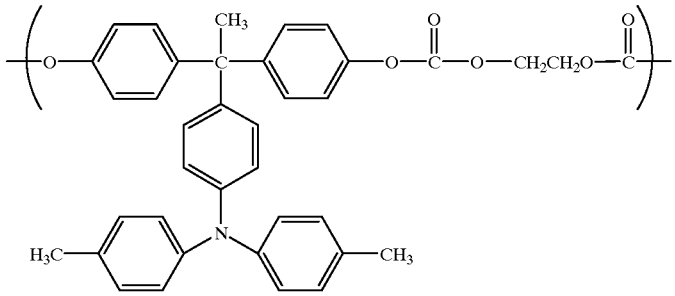

Comparative Example 8

The same procedure as used for Example 38 was repeated, except that the compound No. 6 as the hole-transporting compound was replaced by the compound shown by the structural formula (H), to form and assess the electrophotographic photosensitive member. The electrophotographic photosensitive member showed good initial electrophotographic characteristics, but was much less durable than the one prepared by Example 38. The results are given in Table 3.

Comparative Example 9

The same procedure as used for Example 56 was repeated, except that the compound No. 6 as the hole-transporting compound was replaced by the compound shown by the structural formula (H), to form and assess the electrophotographic photosensitive member. The electrophotographic photosensitive member showed good initial electrophotographic characteristics, but was much less durable than the one prepared by Example 56. The results are given in Table 3.

TABLE 1

| Example | separation | Initial potential characteristics Vd (V) | sensitivity (μJ/cm²) | Vsl (V) | durable image | peeling (μm/10,000 sheets) | potential characteristics changes ΔVd (V) | ΔVl (V) | ΔVsl (V) |
|---|---|---|---|---|---|---|---|---|---|
| 1 | not observed | −700 | 1.00 | −30 | good | 0.35 | 5 | 15 | 10 |
| 2 | not observed | −700 | 1.02 | −30 | good | 0.34 | 5 | 15 | 10 |
| 3 | not observed | −700 | 1.02 | −30 | good | 0.35 | 5 | 15 | 10 |
| 4 | not observed | −700 | 0.99 | −25 | good | 0.34 | 5 | 15 | 10 |
| 5 | not observed | −700 | 1.00 | −30 | good | 0.34 | 5 | 15 | 10 |
| 6 | not observed | −700 | 1.05 | −30 | good | 0.35 | 5 | 15 | 10 |
| 7 | not observed | −700 | 1.08 | −35 | good | 0.22 | 5 | 15 | 5 |
| 8 | not observed | −700 | 1.10 | −35 | good | 0.15 | 5 | 15 | 5 |
| 9 | not observed | −700 | 1.02 | −30 | good | 0.40 | 5 | 15 | 10 |
| 10 | not observed | −700 | 1.53 | −55 | good | 0.43 | 20 | 30 | 20 |
| 11 | not observed | −700 | 1.58 | −55 | good | 0.35 | 20 | 30 | 20 |
| 12 | not observed | −700 | 1.55 | −55 | good | 0.33 | 20 | 35 | 25 |
| 13 | not observed | −700 | 1.60 | −60 | good | 0.32 | 20 | 30 | 20 |
| 14 | not observed | −700 | 1.55 | −55 | good | 0.42 | 20 | 35 | 25 |
| 15 | not observed | −700 | 1.03 | −30 | good | 0.41 | 15 | 20 | 10 |
| 16 | not observed | −700 | 1.02 | −30 | good | 0.42 | 10 | 20 | 10 |
| 17 | not observed | −700 | 1.10 | −35 | good | 0.62 | 30 | 35 | 20 |
| 18 | not observrd | −700 | 1.08 | −35 | good | 0.60 | 30 | 35 | 25 |
| 19 | not observed | −700 | 1.09 | −35 | good | 0.43 | 20 | 20 | 10 |
| 20 | not observed | −700 | 1.11 | −35 | good | 0.65 | 30 | 35 | 25 |
| 21 | not observed | −700 | 1.07 | −30 | good | 0.45 | 20 | 20 | 10 |
| 22 | not observed | −700 | 1.06 | −30 | good | 0.38 | 5 | 15 | 10 |
| 23 | not observed | −700 | 1.05 | −30 | good | 0.42 | 10 | 20 | 10 |
| 24 | not observed | −700 | 1.00 | −30 | good | 0.39 | 10 | 20 | 10 |
| 25 | not observed | −700 | 1.04 | −30 | good | 0.41 | 10 | 20 | 10 |
| 26 | not observed | −700 | 1.18 | −45 | good | 0.31 | 5 | 15 | 10 |
| 27 | not observed | −700 | 1.22 | −50 | good | 0.23 | 5 | 15 | 10 |
| 28 | not observed | −700 | 1.34 | −55 | good | 0.32 | 5 | 15 | 10 |
| 29 | not observed | −700 | 1.01 | −30 | good | 0.35 | 5 | 15 | 10 |
| 30 | not observed | −700 | 1.00 | −30 | good | 0.35 | 5 | 15 | 10 |
| 31 | not observed | −700 | 1.05 | −30 | good | 0.35 | 5 | 15 | 15 |
| 32 | not observed | −700 | 1.18 | −40 | good | 0.32 | 10 | 20 | 15 |

TABLE 2

| Example | separation | Initial potential characteristics Vd (V) | sensitivity (μJ/cm²) | Vsl (V) | durable image | peeling (μm/10,000 sheets) | potential characteristics changes ΔVd (V) | ΔVl (V) | ΔVsl (V) |
|---|---|---|---|---|---|---|---|---|---|
| 33 | not observed | −700 | 1.31 | −50 | good | 0.32 | 10 | 20 | 20 |
| 34 | not observed | −700 | 1.04 | −30 | good | 0.35 | 5 | 15 | 15 |
| 35 | not observed | −700 | 1.04 | −30 | good | 0.40 | 5 | 15 | 15 |
| 36 | not observed | −700 | 1.23 | −40 | good | 0.25 | 5 | 15 | 5 |
| 37 | not observed | −700 | 1.31 | −45 | good | 0.25 | 5 | 15 | 5 |
| 38 | not observed | −700 | 1.85 | −80 | good | 0.56 | 5 | 15 | 10 |
| 39 | not observrd | −700 | 1.88 | −80 | good | 0.64 | 5 | 15 | 10 |
| 40 | not observrd | −700 | 1.82 | −85 | good | 0.62 | 5 | 15 | 10 |
| 41 | not observed | −700 | 1.92 | −90 | good | 0.35 | 5 | 15 | 10 |
| 42 | not observed | −700 | 1.89 | −90 | good | 0.30 | 5 | 15 | 10 |
| 43 | not observed | −700 | 1.81 | −85 | good | 0.72 | 5 | 15 | 10 |
| 44 | not observed | −700 | 2.53 | −95 | good | 0.62 | 20 | 25 | 25 |
| 45 | not obaerved | −700 | 2.55 | −95 | good | 0.52 | 20 | 25 | 20 |
| 46 | not observed | −700 | 1.92 | −80 | good | 0.61 | 5 | 10 | 10 |
| 47 | not observed | −700 | 1.89 | −80 | good | 0.62 | 5 | 10 | 10 |
| 48 | not observed | −700 | 1.88 | −85 | good | 0.58 | 10 | 15 | 10 |
| 49 | not observed | −700 | 2.65 | −95 | good | 0.61 | 15 | 25 | 15 |
| 50 | not observed | −700 | 2.69 | −95 | good | 0.64 | 15 | 25 | 15 |
| 51 | not observed | −700 | 2.55 | −90 | good | 0.63 | 15 | 25 | 15 |
| 52 | not observed | −700 | 2.43 | −90 | good | 0.50 | 5 | 15 | 10 |
| 53 | not observed | −700 | 1.92 | −80 | good | 0.51 | 5 | 10 | 10 |
| 54 | not observed | −700 | 1.78 | −80 | good | 0.53 | 5 | 10 | 10 |

TABLE 2-continued

| Example | separation | Initial potential characteristics Vd (V) | sensitivity ($\mu J/cm^2$) | Vsl (V) | durable image | peeling ($\mu m$/10,000 sheets) | potential characteristics changes ΔVd (V) | ΔVl (V) | ΔVsl (V) |
|---|---|---|---|---|---|---|---|---|---|
| 55 | not observed | −700 | 1.83 | −80 | good | 0.54 | 5 | 10 | 10 |
| 56 | not observed | −700 | 2.12 | −80 | good | 0.49 | 5 | 15 | 10 |
| 57 | not observed | −700 | 2.89 | −95 | good | 0.52 | 10 | 20 | 15 |
| 58 | not observed | −700 | 2.01 | −80 | good | 0.47 | 5 | 15 | 10 |
| 59 | not observed | −700 | 2.11 | −80 | good | 0.50 | 10 | 15 | 10 |
| 60 | not observed | −700 | 1.68 | −65 | good | 0.55 | 5 | 10 | 10 |
| 61 | not observed | −700 | 2.01 | −80 | good | 0.61 | 15 | 20 | 15 |
| 62 | not observed | −700 | 1.86 | −70 | good | 0.40 | 5 | 5 | 10 |
| 63 | not observed | −700 | 2.12 | −90 | good | 0.48 | 15 | 15 | 20 |
| 64 | not observed | −700 | 1.93 | −70 | good | 0.40 | 5 | 10 | 10 |

TABLE 3

| Example | separation | Initial potential characteristics Vd (V) | sensitivity ($\mu J/cm^2$) | Vsl (V) | durable image | peeling ($\mu m$/10,000 sheets) | potential characteristics changes ΔVd (V) | ΔVl (V) | ΔVsl (V) |
|---|---|---|---|---|---|---|---|---|---|
| 1 | separation in 14 days | −700 | 1.50 | −80 | scratches was produced after 1,500 sheets fogging was produced after 3,000 sheets image was not produced after 8,000 sheets by insufficient charge | 15 (conversion value at 10,000 sheets) durability test was completed after 8,000 sheets | — | — | — |
| 2 | no seperation in 14 days and separation in 30 days | −700 | 1.53 | −90 | scratches and fogging were produced after 5,000 sheets | 8 | 30 | 40 | 40 |
| 3 | not observed | −700 | 2.21 | −120 | image gost was produced at initial stage scratches and fogging were produced after 8,000 sheets | 5 | 20 | 30 | 60 |
| 4 | not observed | −700 | 1.50 | −70 | scratches and fogging were produced after 8,000 sheets | 5 | 20 | 30 | 30 |
| 5 | not observed | −700 | 1.12 | −35 | scratches and fogging were produced after 6,000 sheets | 7 | 30 | 40 | 50 |
| 6 | not observed | −700 | 1.20 | −50 | scratches and fogging were produced after 8,000 sheets | 5 | 30 | 30 | 30 |
| 7 | not observed | −700 | 1.72 | −70 | scratches and fogging were prodsuced after 8,000 sheets | 5 | 20 | 30 | 20 |
| 8 | not observed | −700 | 1.76 | −80 | scratches and fogging were produced and 5,000 sheets | 8.5 | 40 | 40 | 50 |
| 9 | not observed | −700 | 1.98 | −80 | scratches and foggingwere produced after 7,000 sheets | 6 | 35 | 30 | 30 |

What is claimed is:

1. An electrophotographic photosensitive member, comprising a support and photosensitive layer thereon, wherein said photosensitive layer contains at least one of a hole-transporting compound with two or more chain-polymerizing functional groups in the same molecule and the compound hardened by polymerizing or cross-linking the above hole-transporting compound.

2. The electrophotographic photosensitive member according to claim 1, wherein said hole-transporting compound is shown by the general formula (1):

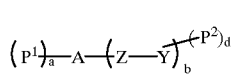

(1)

wherein A is a hole-transporting group; $P^1$ and $P^2$ are each a chain-polymerizing functional group, and may be the same or different; Z is an organic residue which may have a substituent; Y is hydrogen atom; and a, b and d are each an integer of 0 or more, where b+d is an integer of 3 or more when a is zero, a is an integer of 2 or more when b or d is zero, and a+b+d is an integer of 3 or more in all other cases;

and $P^1$ may be the same or different when a is 2 or more, $P^2$ may be the same or different when d is 2 or more, and Z may be the same or different when b is 2 or more.

3. The electrophotographic photosensitive member according to claim 2, wherein Z in the general formula (1) is an alkylene group which may have a substituent; arylene group which may have a substituent; $CR^1{=}CR^2$ (wherein $R^1$ and $R^2$ are each an alkyl group which may have a substituent, aryl group which may have a substituent, or hydrogen atom, and may be the same or different); C=O , S=O, $SO_2$, or organic residue containing at least one of oxygen and sulfur atoms, which may be arbitrarily combined with each other.

4. The electrophotographic photosensitive member according to claim 3, wherein Z in the general formula (1) is shown by the following general formula (2):

$$-(X^1)_p-(Ar^1)_q-(X^2)_r-(Ar^2)_s-(X^3)_t- \quad (2)$$

wherein, $X^1$ to $X^3$ are each an alkylene group which may have a substituent, $(CR^1{=}CR^2)_m$, C=O, S=O, $SO_2$, or oxygen or sulfur atom; $Ar^1$ and $Ar^2$ are each an aryl group which may have a substituent;

$R^1$ and $R^2$ are each an alkyl group which may have a substituent, aryl group which may have a substituent or hydrogen atom, where $R^1$ and $R^2$ may be the same or different; and m is an integer of 1 to 5 and p to t are each an integer of 0 to 10, where p to t are not simultaneously zero.

5. The electrophotographic photosensitive member according to claim 4, wherein Z in the general formula (1) is shown by the following general formula (3):

$$-(X^4)_u-(A^3)_v-(X^5)_w- \quad (3)$$

wherein, $Ar^3$ is an arylene group which may have a substituent; $X^4$ and $X^5$ are each $(CH_2)_{m'}$, $(CH{=}CR^3)_{n'}$, C=O or oxygen atom;

$R^3$ is an alkyl group which may have a substituent, aryl group which may have a substituent or hydrogen atom; and m is an integer of 1 to 10, n is an integer of 1 to 5 and u to w are each an integer of 0 to 10, where u to w are not simultaneously zero.

6. The electrophotographic photosensitive member according to claim 2, wherein each of P' and Z in A is substituted by hydrogen atom to form a hydrogen adduct shown by the following general formula (4):

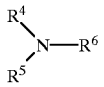

(4)

wherein, $R^4$, $R^5$ and $R^6$ are each an alkyl group which may have a substituent, aralkyl group which may have a substituent, or aryl group which may have a substituent, $R^4$, $R^5$ and $R^6$ may be the same or different, and at least two of them are aryl groups.

7. The electrophotographic photosensitive member according to claim 6, wherein all of $R^4$, $R^5$ and $R^6$ are an aryl group.

8. The electrophotographic photosensitive member according to claim 2, wherein at least one of $P^1$ and $P^2$ is an unsaturated polymerizing functional group shown by the following general formula (5):

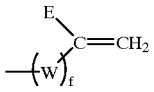

(5)

wherein, E is hydrogen atom, a halogen atom, alkyl group which may have a substituent, aralkyl group which may have a substituent, aryl group which may have a substituent, cyano group, nitro group, alkoxy group, —$COOR^7$ (wherein $R^7$ is hydrogen atom, a halogen atom, alkyl group which may have a substituent, aralkyl group which may have a substituent, or aryl group which may have a substituent), $CONR^8R^9$ ($R^8$ and $R^9$ are each hydrogen atom, a halogen atom, alkyl group which may have a substituent, aralkyl group which may have a substituent, or aryl group which may have a substituent, where $R^8$ and $R^9$ may be the same or different); and W is an arylene group which may have a substituent, alkylene group which may have a substituent, or —COO—, —$CH_2$—, —O—, —OO—, —S— or $CONR^{10}$— (wherein $R^{10}$ is hydrogen atom, a halogen atom, alkyl group which may have a substituent, aralkyl group which may have a substituent, or aryl group which may have a substituent); and f is 0 or 1.

9. The electrophotographic photosensitive member according to claim 2, wherein at least one of $P^1$ and $P^2$ is a cyclic ether group shown by the following general formula (6):

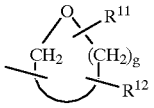

(6)

wherein $R^{11}$ and $R^{12}$ are each hydrogen atom, an alkyl group which may have a substituent, aralkyl group which may have a substituent, or aryl group which may have a substituent; and g is an integer of 1 to 10.

10. The electrophotographic photosensitive member according to claim 2, wherein at least one of $P^1$ and $P^2$ is an alicyclic epoxy group shown by the following general formula (7):

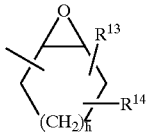

(7)

wherein $R^{13}$ and $R^{14}$ are each hydrogen atom, an alkyl group which may have a substituent, aralkyl group which may have a substituent; or aryl group which may have a substituent; and h is an integer of 0 to 10.

11. The electrophotographic photosensitive member according to claim 2, wherein at least one of $P^1$ and $P^2$ is shown by the formula selected from the group consisting of formulae (8) to (14):

(8)

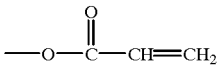

(9)

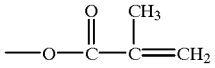

(10)

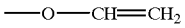

(11)

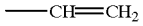

(12)

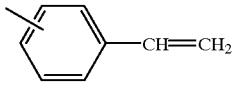

(13)

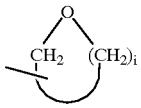

wherein i is an integer of 1 to 3

(14)

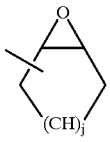

wherein j is an integer of 1 to 3.

12. The electrophotographic photosensitive member according to claim 11, wherein at least one of $P^1$ and $P^2$ is shown by the formula selected from the group consisting of formulae (8) and (9):

(8)

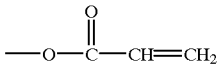

(9)

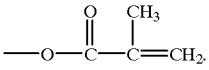

13. A process cartridge comprising an electrophotographic photosensitive member and at least one of the means selected from the group consisting of those for electrification, development and cleaning, wherein said electrophotographic photosensitive member and at least one of said means are monolithically supported to form an assembly freely attachable to or detachable from an electrophotographic apparatus body, and said electrophotographic photosensitive member comprises a support and photosensitive layer thereon, said photosensitive layer containing at least one of a hole-transporting compound with two or more chain-polymerizing functional groups in the same molecule and the compound hardened by polymerizing or cross-linking the above hole-transporting compound.

14. An electrophotographic apparatus comprising an electrophotographic photosensitive member, and means for electrification, exposure, development and transferring, said electrophotographic photosensitive member comprising a support and photosensitive layer thereon, wherein said photosensitive layer contains at least one of a hole-transporting compound with two or more chain-polymerizing functional groups in the same molecule and the compound hardened by polymerizing or cross-linking the above hole-transporting compound.

15. A process for producing an electrophotographic photosensitive member which has a support and photosensitive layer thereon, comprising a step for forming a photosensitive layer for said electrophotographic photosensitive member, wherein said step hardens a hole-transporting compound with two or more chain-polymerizing functional groups in the same molecule by polymerization or cross-linking.

16. The process for producing an electrophotographic photosensitive member according to claim 15, wherein said hole-transporting compound is shown by the general formula (1):

(1)

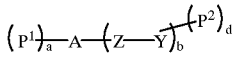

wherein A is a hole-transporting group; $P^1$ and $P^2$ are each a chain-polymerizing functional group, and may be the same or different; Z is an organic residue which may have a substituent; Y is hydrogen atom; and a, b and d are each an integer of 0 or more, where b+d is an integer of 3 or more when a is zero, a is an integer of 2 or more when b or d is zero, and a+b+d is an integer of 3 or more in all other cases; and $P^1$ may be the same or different when a is 2 or more, $P^2$ may be the same or different when d is 2 or more, and Z may be the same or different when b is 2 or more.

17. The process for producing an electrophotographic photosensitive member according to claim 16, wherein Z in the general formula (1) is an alkylene group which may have a substituent; arylene group which may have a substituent; $CR^1{=}CR^2$ (wherein $R^1$ and $R^2$ are each an alkyl group which may have a substituent, aryl group which may have a substituent, or hydrogen atom, and may be the same or different); C=O , S=O, $SO_2$, or organic residue containing at least one of oxygen and sulfur atoms, which may be arbitrarily combined with each other.

18. The process for producing an electrophotographic photosensitive member according to claim 17, wherein Z in the general formula (1) is shown by the following general formula (2):

(2)

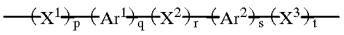

wherein, $X^1$ to $X^3$ are each an alkylene group which may have a substituent, $(CR^1{=}CR^2)_m$, C=O, S=O, $SO_2$, or oxygen or sulfur atom; $Ar^1$ and $Ar^2$ are each an arylene group which may have a substituent;

$R^1$ and $R^2$ are each an alkyl group which may have a substituent, aryl group which may have a substituent or hydrogen atom, where $R^1$ and $R^2$ may be the same or different; and m is an integer of 1 to 5 and p to t are each an integer of 0 to 10, where p to t are not simultaneously zero.

19. The process for producing an electrophotographic photosensitive member according to claim 18, wherein Z in the general formula (1) is shown by the following general formula (3):

(3)

$$-(X^4)_u-(A^3)_v-(X^5)_w-$$

wherein, $Ar^3$ is an arylene group which may have a substituent; $X^4$ and $X^5$ are each $(CH_2)_{m'}$, $(CH{=}CR^3)_{n'}$, C=O or oxygen atom;

$R^3$ is an alkyl group which may have a substituent, aryl group which may have a substituent or hydrogen atom; and m is an integer of 1 to 10, n is an integer of 1 to 5 and u to w are each an integer of 0 to 10, where u to w are not simultaneously zero.

20. The process for producing an electrophotographic photosensitive member according to claim 16, wherein each of $P^1$ and Z in A is substituted by hydrogen atom to form a hydrogen adduct shown by the following general formula (4):

(4)

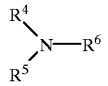

wherein, $R^4$, $R^5$ and $R^6$ are each an alkyl group which may have a substituent, aralkyl group which may have a substituent, or aryl group which may have a substituent, $R^4$, $R^5$ and $R^6$ may be the same or different, and at least two of them are aryl groups.

21. The process for producing an electrophotographic photosensitive member according to claim 20, wherein all of $R^4$, $R^5$ and $R^6$ are an aryl group.

22. The process for producing an electrophotographic photosensitive member according to claim 16, wherein at least one of $P^1$ and $P^2$ is an unsaturated polymerizing functional group shown by the following general formula (5):

(5)

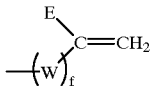

wherein E is hydrogen atom, a halogen atom, alkyl group which may have a substituent, aralkyl group which may have a substituent, aryl group which may have a substituent, cyano group, nitro group, alkoxy group, —$COOR^7$ (wherein $R^7$ is hydrogen atom, a halogen atom, alkyl group which may have a substituent, aralkyl group which may have a substituent, or aryl group which may have a substituent), $CONR^8R^9$ (wherein $R^8$ and $R^9$ are each hydrogen atom, a halogen atom, alkyl group which may have a substituent, aralkyl group which may have a substituent, or aryl group which may have a substituent, where $R^8$ and $R^9$ may be the same or different); and W is an arylene group which may have a substituent, alkylene group which may have a substituent, or —COO—, —$CH_2$—, —O—, —OO—, —S— or $CONR^{10}$— (wherein $R^{10}$ is hydrogen atom, a halogen atom, alkyl group which may have a substituent, aralkyl group which may have a substituent, or aryl group which may have a substituent); and f is 0 or 1.

23. The process for producing an electrophotographic photosensitive member according to claim 16, wherein at least one of $P^1$ and $P^2$ is a cyclic ether group shown by the following general formula (6):

(6)

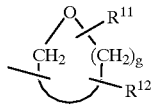

wherein $R^{11}$ and $R^{12}$ are each hydrogen atom, an alkyl group which may have a substituent, aralkyl group which may have a substituent, or aryl group which may have a substituent; and g is an integer of 1 to 10.

24. The process for producing an electrophotographic photosensitive member according to claim 16, wherein at least one of $P^1$ and $P^2$ is an alicyclic epoxy group shown by the following general formula (7):

(7)

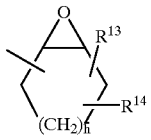

wherein $R^{13}$ and $R^{14}$ are each hydrogen atom, an alkyl group which may have a substituent, aralkyl group which may have a substituent; or aryl group which may have a substituent; and h is an integer of 0 to 10.

25. The process for producing an electrophotographic photosensitive member according to claim 16, wherein at least one of $P^1$ and $P^2$ is shown by the formula selected from the group consisting of formulae (8) to (14):

(8)

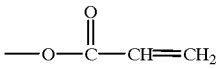

(9)

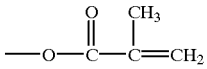

(10)

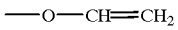

(11)

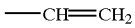

(12)

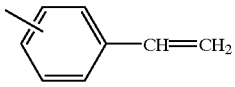

(13)

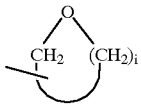

wherein i is an integer of 1 to 3

(14)

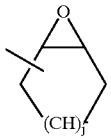

wherein j is an integer of 1 to 3.

26. The process for producing an electrophotographic photosensitive member according to claim 25, wherein at least one of $P^1$ and $P^2$ is shown by the formula selected from the group consisting of formulae (8) and (9):

(8)

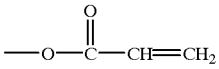

(9)

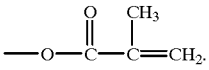

27. The process for producing an electrophotographic photosensitive member according to claim 15, wherein said polymerization/cross-linking is effected by the aid of one of radioactive ray, heat and light.

28. The process for producing an electrophotographic photosensitive member according to claim 27, wherein said polymerization/cross-linking is effected by the aid of radioactive ray.

29. The process for producing an electrophotographic photosensitive member according to claim 28, wherein said radioactive ray is electron ray.

30. The process for producing an electrophotographic photosensitive member according to claim 28, wherein said polymerization/cross-linking is effected without using a polymerization initiator.

31. The process for producing an electrophotographic photosensitive member according to claim 28, wherein said electrophotographic photosensitive member is irradiated with electron ray at an acceleration voltage of 300 KV or less.

32. The process for producing an electrophotographic photosensitive member according to claim 28, wherein said electrophotographic photosensitive member is irradiated with electron ray at a dose of 1 to 100 Mrad.

* * * * *

UNITED STATES PATENT AND TRADEMARK OFFICE

CERTIFICATE OF CORRECTION

PATENT NO. : 6,180,303 B1 
DATED : January 30, 2001
INVENTOR(S) : Hiroki Uematsu et al.

It is certified that error appears in the above-identified patent and that said Letters Patent is hereby corrected as shown below:

Title page,
Item [74], *Attorney, Agent of Firm*, "Fitzpatrick, Cella Harper & Scinto" should read -- Fitzpatrick, Cella, Harper & Scinto --.

Column 4,
Line 23, "C═C," (first occurrence) should read --C≡C,--;

Line 24, "react" should read -- react to --;
Line 50, "

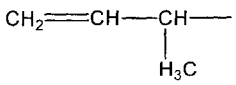

should read

-- $CH_2{=}CH(OR)-$ --.
$CH_2{=}CH-CH_2$
$CH_2{=}CH-CH(CH_3)-$

Column 6,
Line 56, "include" should read -- included --.

Column 9,
Line 5, "$-(X^4)_u-(A^3)_v-(X^5)_w-$" should read -- $-(X^4)_u-(Ar^3)_v-(X^5)_w-$ --;

Line 9, "include" should read -- included --.

Column 15,
Exemplary Compound 13,

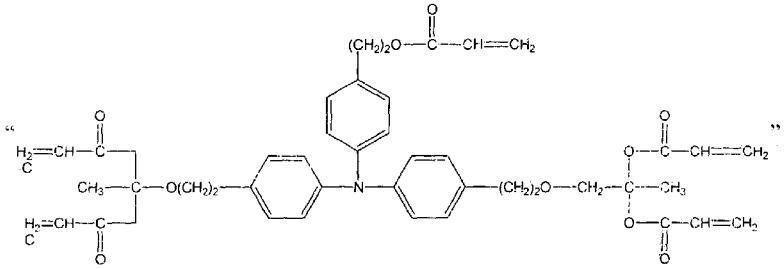

CERTIFICATE OF CORRECTION

PATENT NO. : 6,180,303 B1
DATED : January 30, 2001
INVENTOR(S) : Hiroki Uematsu et al.

It is certified that error appears in the above-identified patent and that said Letters Patent is hereby corrected as shown below:

should read

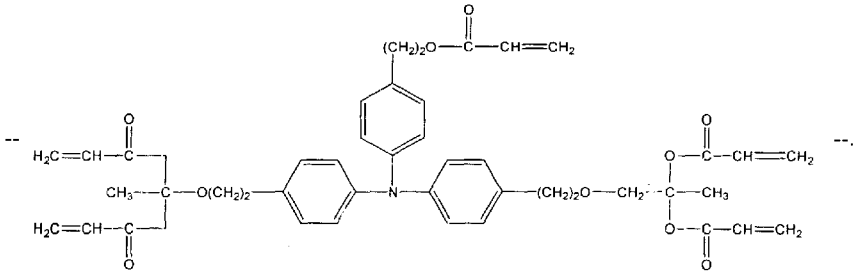

Column 57,
Line 37, “preferable” should read -- preferably --.

Column 59,
Line 12, “weight at” should read -- weight. At --.

Column 64,
Lien 57, “acceleqation” should read -- (acceleration) --.

Column 75,
Table 3, Ex. 1, “scratches was” should read -- scratches were --;
Table 3, Ex. 3, “gost” should read -- ghost --;
Table 3, Ex. 7, “produced” should read -- produced --;
Table 3, Ex. 9, “foggingwere” should read -- fogging were --.

Column 77,
Line 23, “aryl” should read -- arylene --;
Line 36, “ $-\left(X^4\right)_u-\left(A^3\right)_v-\left(X^5\right)_w-$ ” should read -- $-\left(X^4\right)_u-\left(Ar^3\right)_v-\left(X^5\right)_w-$ --;

Line 44, “m” should read -- m´ --; and “n” should read -- n´ --;
Line 48, “P´” should read -- $P^1$ --;
Line 65, “group.” should read -- group which may have a substituent. --.

Column 78,
Line 18, “$R^8$” should read -- wherein $R^8$ --.

UNITED STATES PATENT AND TRADEMARK OFFICE

CERTIFICATE OF CORRECTION

PATENT NO. : 6,180,303 B1 
DATED : January 30, 2001
INVENTOR(S) : Hiroki Uematsu et al.

It is certified that error appears in the above-identified patent and that said Letters Patent is hereby corrected as shown below:

Column 79,
Line 30,

“ 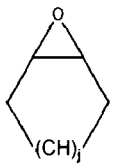 ” should read -- 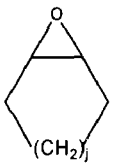 --.

Column 81,
Line 9,

“ $-\left(X^4\right)_w\left(A^3\right)_v\left(X^5\right)_w-$ ” should read -- $-\left(X^4\right)_w\left(Ar^3\right)_v\left(X^5\right)_w-$ --.

Line 18, “m” should read -- m´ --; and “n” should read -- n´ --;
Line 40, “group.” should read -- group which may have a substituent. --;

Column 83,
Line 5,

“ 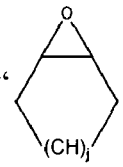 ” should read -- 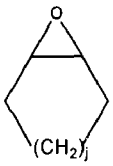 --.

Signed and Sealed this

Twenty-fifth Day of June, 2002

*Attest:*

*Attesting Officer*

JAMES E. ROGAN
*Director of the United States Patent and Trademark Office*